US008528669B2

(12) United States Patent
Twardowski et al.

(10) Patent No.: US 8,528,669 B2
(45) **Date of Patent: *Sep. 10, 2013**

(54) EARTH REMOVAL MEMBER WITH FEATURES FOR FACILITATING DRILL-THROUGH

(75) Inventors: Eric M. Twardowski, Spring, TX (US); Albert C. Odell, II, Kingwood, TX (US); Guy F. Feasey, London (GB); Scott Beattie, Kuala Lumpur (MY); Sharp Okorie Ugwuocha, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/305,452

(22) Filed: Nov. 28, 2011

(65) Prior Publication Data

US 2012/0103694 A1 May 3, 2012

Related U.S. Application Data

(62) Division of application No. 12/558,277, filed on Sep. 11, 2009, now Pat. No. 8,074,749.

(51) Int. Cl.
*E21B 10/61* (2006.01)
*E21B 10/42* (2006.01)

(52) U.S. Cl.
USPC ..... 175/393; 175/402; 166/242.8

(58) Field of Classification Search
USPC ..... 166/242.8; 175/339, 340, 393, 402, 175/424
See application file for complete search history.

(56) References Cited

U.S. PATENT DOCUMENTS

| | | | | |
|---|---|---|---|---|
| 1,388,490 | A | 8/1921 | Suman | |
| 2,408,892 | A * | 10/1946 | Stokes | 175/393 |
| 2,721,058 | A * | 10/1955 | Boice | 175/393 |
| 2,738,011 | A | 3/1956 | Mabry | |
| 3,419,220 | A * | 12/1968 | Goodwin et al. | 239/591 |
| 3,621,910 | A | 11/1971 | Sanford et al. | |

(Continued)

FOREIGN PATENT DOCUMENTS

CN 200978623 11/2007

OTHER PUBLICATIONS

Weatherford International Ltd.—"DrillShoe III" brochure, date unknown, 4 pages.

(Continued)

*Primary Examiner* — Giovanna Wright
*Assistant Examiner* — Robert E Fuller
(74) *Attorney, Agent, or Firm* — Patterson & Sheridan, L.L.P.

(57) ABSTRACT

An earth removal member for drilling a wellbore with casing or liner includes a tubular body and a head. The head is fastened to or formed with an end of the body, has a face and a side, is made from a high strength material, and has a port formed through the face. The earth removal member further includes a blade. The blade is formed on the head, extends from the side and along the face, and is made from the high strength material. The earth removal member further includes cutters disposed along the blade; and a nozzle adapter. The nozzle adapter has a port formed therethrough, is longitudinally and rotationally coupled to the head, and is made from a drillable material. The earth removal member further includes a nozzle disposed in the adapter port and fastened to the nozzle adapter.

17 Claims, 27 Drawing Sheets

(56) References Cited

U.S. PATENT DOCUMENTS

| | | | | |
|---|---|---|---|---|
| 3,645,331 | A | 2/1972 | Maurer et al. | |
| 3,688,853 | A | 9/1972 | Maurer et al. | |
| 4,273,190 | A | 6/1981 | Baker et al. | |
| 4,396,077 | A * | 8/1983 | Radtke | 175/428 |
| 4,397,355 | A | 8/1983 | McLamore | |
| 4,739,845 | A | 4/1988 | Dennis | |
| 4,878,548 | A | 11/1989 | Ostertag et al. | |
| 5,195,591 | A | 3/1993 | Blount et al. | |
| 5,271,472 | A | 12/1993 | Leturno | |
| 5,647,437 | A | 7/1997 | Braddick et al. | |
| 5,950,742 | A | 9/1999 | Caraway | |
| 5,957,225 | A | 9/1999 | Sinor | |
| 5,967,244 | A | 10/1999 | Arfele | |
| 6,062,326 | A | 5/2000 | Strong et al. | |
| 6,106,200 | A | 8/2000 | Mocivnik et al. | |
| 6,142,248 | A | 11/2000 | Thigpen et al. | |
| 6,192,999 | B1 * | 2/2001 | Nguyen | 175/340 |
| 6,263,987 | B1 | 7/2001 | Vail, III | |
| 6,311,793 | B1 | 11/2001 | Larsen et al. | |
| 6,390,211 | B1 | 5/2002 | Tibbitts | |
| 6,408,957 | B1 | 6/2002 | Slaughter, Jr. et al. | |
| 6,443,247 | B1 | 9/2002 | Wardley | |
| 6,454,007 | B1 | 9/2002 | Bailey | |
| 6,585,063 | B2 | 7/2003 | Larsen | |
| 6,983,811 | B2 | 1/2006 | Wardley | |
| 7,077,212 | B2 | 7/2006 | Roesner et al. | |
| 7,096,982 | B2 | 8/2006 | McKay et al. | |
| 7,188,682 | B2 * | 3/2007 | Larsen et al. | 175/57 |
| 7,216,727 | B2 | 5/2007 | Wardley | |
| 7,311,148 | B2 | 12/2007 | Giroux et al. | |
| 7,395,882 | B2 | 7/2008 | Oldham et al. | |
| 8,074,749 | B2 * | 12/2011 | Twardowski et al. | 175/393 |
| 2003/0024742 | A1 | 2/2003 | Swietlik et al. | |
| 2003/0164250 | A1 | 9/2003 | Wardley | |
| 2004/0011534 | A1 | 1/2004 | Simonds et al. | |
| 2004/0020635 | A1 | 2/2004 | Connell et al. | |
| 2004/0118614 | A1 | 6/2004 | Galloway et al. | |
| 2004/0245020 | A1 | 12/2004 | Giroux et al. | |
| 2006/0185855 | A1 | 8/2006 | Jordan et al. | |
| 2006/0278442 | A1 | 12/2006 | Kristensen | |
| 2009/0120693 | A1 | 5/2009 | McClain et al. | |
| 2010/0307837 | A1 | 12/2010 | King et al. | |

OTHER PUBLICATIONS

Australian Office Action dated Jul. 13, 2011, Australian Patent Application No. 2010219396.

Canadian Office Action dated Dec. 12, 2011, Canadian Patent Application No. 2,714,545.

Extended European Search Report dated Mar. 2, 2012, European Patent Application No. 10176279.7.

* cited by examiner

EARTH REMOVAL MEMBER WITH FEATURES FOR FACILITATING DRILL-THROUGH

CROSS-REFERENCE TO RELATED APPLICATIONS

This application is a divisional of U.S. patent application Ser. No. 12/558,277, filed on Sep. 11, 2009 and issued as U.S. Pat. No. 8,074,749 on Dec. 13, 2011, which is herein incorporated by reference in its entirety.

BACKGROUND OF THE INVENTION

1. Field of the Invention

Embodiments of the present invention generally relate to an earth removal member with features for facilitating subsequent drill-through.

2. Description of the Related Art

The drilling of wellbores for oil and gas production conventionally employs strings of drill pipe to which, at one end, is secured a drill bit. After a selected portion of the wellbore has been drilled, the wellbore is usually cased with a string of casing or lined with a string of liner. Drilling and casing/lining according to the conventional process typically requires sequentially drilling the wellbore using drill string with a drill bit attached thereto, removing the drill string and drill bit from the wellbore, and disposing casing/lining into the wellbore. Further, often after a section of the borehole cased/lined, which is usually cemented into place, additional drilling beyond the end of the casing/liner may be desired.

Unfortunately, sequential drilling and casing may be time consuming because, as may be appreciated, at the considerable depths reached during oil and gas production, the time required to retrieve the drill string may be considerable. Thus, such operations may be costly as well due to the high cost of rig time. Moreover, control of the well may be difficult during the period of time that the drill pipe is being removed and the casing/lining is being disposed into the borehole.

Some approaches have been developed to address the difficulties associated with conventional drilling and casing/lining operations. Of initial interest is an apparatus which is known as a reaming casing shoe that has been used in conventional drilling operations. Reaming casing shoes have become available relatively recently and are devices that are able to drill through modest obstructions within a borehole that has been previously drilled. In addition, the reaming casing shoe may include an inner section manufactured from a material which is drillable by drill bits. Accordingly, when cemented into place, the reaming casing shoe usually poses no difficulty to a subsequent drill bit.

As a further extension of the reaming casing shoe concept, in order to address the problems with sequential drilling and casing, drilling with casing/liner is gaining popularity as a method for drilling a wellbore, wherein the casing/liner is used as the drill string and, after drilling, the casing/liner remains downhole to line the wellbore. Drilling with casing/liner employs a drill bit attached to the casing/liner string, so that the drill bit functions not only to drill the earth formation, but also to guide the casing/liner into the wellbore. This may be advantageous as the casing/liner is disposed into the wellbore as it is formed by the drill bit, and therefore eliminates the necessity of retrieving the drill string and drill bit after reaching a target depth where cementing is desired.

While this procedure greatly increases the efficiency of the drilling procedure, a further problem is encountered when the casing/liner is cemented upon reaching the desired depth.

While one advantage of drilling with casing is that the drill bit does not have to be retrieved from the wellbore, further drilling may be required. Thus, further drilling must pass through the drill bit attached to the end of the casing/liner.

However, drilling through the casing/liner drill bit may be difficult as drill bits are required to remove rock from formations and accordingly often include very drilling resistant, robust structures typically manufactured from hard or superhard materials. Attempting to drill through a drill bit affixed to the end of a casing/liner may result in damage to the subsequent drill bit and bottom-hole assembly deployed or possibly the casing/liner itself. It may be possible to drill through a drill bit or a casing with special tools known as mills, but these tools are unable to penetrate rock formations effectively and the mill would have to be retrieved or "tripped" from the wellbore and replaced with a drill bit. In this case, the time and expense saved by drilling with casing would be mitigated or even lost.

SUMMARY OF THE INVENTION

Embodiments of the present invention generally relate to an earth removal member with features for facilitating subsequent drill-through. In one embodiment, an earth removal member for drilling a wellbore with casing or liner includes a tubular body and a head. The head is fastened to or formed with an end of the body, has a face and a side, is made from a high strength material, and has a port formed through the face. The earth removal member further includes a blade. The blade is formed on the head, extends from the side and along the face, and is made from the high strength material. The earth removal member further includes cutters disposed along the blade; and a nozzle adapter. The nozzle adapter has a port formed therethrough, is longitudinally and rotationally coupled to the head, and is made from a drillable material. The earth removal member further includes a nozzle disposed in the adapter port and fastened to the nozzle adapter.

In another embodiment, a casing bit for drilling a wellbore with casing or liner includes a tubular body and a head. The head is fastened to or formed with an end of the body, has a face and a side, is made from a high strength steel, and has a port formed through the face. The casing bit further includes blades. The blades are formed on the head, extend from the side and along the face, are made from the high strength steel, and have recesses formed in an external surface thereof and occupying a substantial volume of the blades. The casing bit further includes cutters disposed along the blade and made from polycrystalline diamond compact. The casing bit further includes a nozzle adapter having a port formed therethrough and made from a drillable material. The casing bit further includes one or more fasteners longitudinally and rotationally coupling the nozzle adapter to the head; anchors formed on a surface of the nozzle adapter and extending into or through the face underneath the blades; one or more chip-breakers formed in the surface of the nozzle adapter; and a nozzle disposed in the ports and fastened to the nozzle adapter.

In another embodiment, an earth removal member for drilling a wellbore with casing or liner includes: a tubular body; and a head. The head is fastened to or formed with an end of the body, has a face and a side, is made from a high strength material, has a boss extending from a rear of the face, and has a port formed through the boss and the face. The earth removal member further includes a blade. The blade is formed on the head and extends from the side and along the face and is made from the high strength material. The earth removal member further includes cutters disposed along the blade and a nozzle disposed in the port and fastened to the boss.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 8G illustrates the nozzle adapter after being substantially drilled-through.

DETAILED DESCRIPTION

Figure 1:
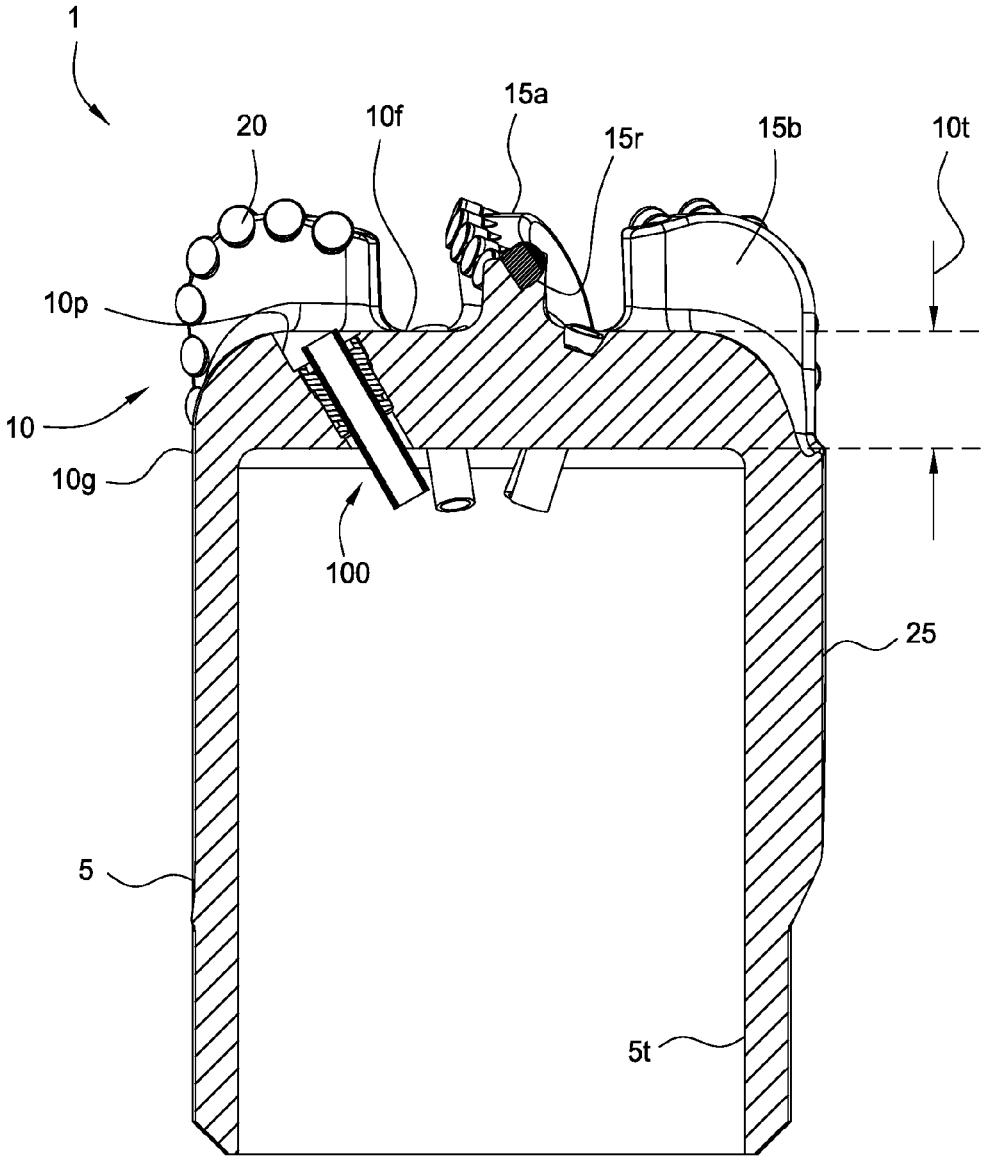
FIG. 1 is a cross section of an earth removal member, such as a casing bit, according to one embodiment of the present invention.

FIG. 1 is a cross section of an earth removal member, such as a casing bit 1, according to one embodiment of the present invention. Alternatively, the earth removal member may be a drill bit, reamer shoe, a pilot bit, a core bit, or a hammer bit. The casing bit 1 may include a body 5, a head 10, one or more blades 15*a,b*, one or more cutters 20, one or more stabilizers 25, and one or more nozzles 100. As shown, the body 5, the head 10, and the blades 15*a,b* may be integrally formed, such as by casting. The body 5 may be tubular and have a threaded inner surface 5*t* for connection with a bottom of a casing or liner string (not shown) or a casing adapter having a pin or box for connection with the casing or liner bottom. Since the blades 15*a,b* may be formed integrally with the head 10, the casing bit 1 may be classified as a fixed-cutter bit.

Alternatively (see FIG. 2), the head 210 and blades 215*a,b* may be formed integrally, such as by casting, and the head 210 may include a threaded outer surface 210*c* for connection with a separately formed tubular body (not shown) having a threaded inner surface. Additionally or alternatively, the casing adapter may be welded to the body.

The head 10 may include a front or face 10*f* and a side 10*g*. The face 10*f* may be milled/drilled through and the side 10*g* may remain after drill/mill-through. The face 10*f* may be milled/drilled through after cementing the casing and the casing bit to the wellbore. The blades 15*a* may each extend from the side 10*g* radially or helically to a center of the face 10*f*. The blades 15*b* may extend radially or helically from the side 10*g* to a substantial distance toward the face center, such as greater than or equal to one-third or one-half the radius of the head 10. A gage portion of the blades 15*a,b* may extend radially outward past an outer surface of the head 10. A height of the blades may decrease as the blades 15*a,b* extend from the side 10*g* toward the face center. Fluid courses may be formed between facial portions of the blades 15*a,b* and the face 10*f* and junk slots may be formed between gage portions of the blades and the side 10*g*. The fluid courses may conduct drilling fluid (not shown) discharged from the nozzles 100 from the face 10*f* to the junk slots, thereby carrying cuttings from the blades 15*a,b*. The cutters 20 may be bonded into respective recesses 15*r* formed along each blade 15*a,b*. The cutters 20 may be made from a super-hard material, such as polycrystalline diamond compact (PDC), natural diamond, or cubic boron nitride. The PDC may be conventional, cellular, or thermally stable (TSP). The cutters 20 may be bonded into the recesses 15*r*, such as by brazing, welding, soldering, or using an adhesive. The cutters 20 may be disposed along each blade 15*a,b* and be located in both gage and face portions of each blade.

Alternatively, the cutters 20 may be fastened to the blades 15*a,b*. Alternatively, the blades 15*a,b* may be omitted and the cutters 20 may be disposed in the head 10, such as in the face 10*f* and/or side 10*g*.

The stabilizers 25 may extend longitudinally and/or helically along the body 5. The stabilizers 25 may be aligned with the blades 15*a,b* and also have fluid channels formed therebetween. An outer surface of the stabilizers 25 may extend outward past the gage portion of each blade 15*a,b*. Inserts, such as buttons (not shown), may be disposed along an outer surface of each of the stabilizers 25. The inserts may be made from a wear-resistant material, such as a ceramic or cermet (i.e., tungsten carbide). The inserts may be brazed, welded, or pressed into recesses formed in the outer surface of the stabilizers 25 so that the buttons are flush with or extend outward past the stabilizer outer surface. The stabilizers 25 may also serve to rotationally couple the body 10 and the side 10*g* to the wellbore during drill/mill-through as the casing/liner and the casing bit 1 may be cemented to the wellbore before drill/mill-through.

The body 5, the head 10, and the blades 15 may be made from a metal or alloy, such as steel, or a composite, such as a cermet. The steel may be a low alloy or plain carbon steel. The steel may have a high yield strength, such as greater than or equal to thirty-six ksi; preferably fifty ksi; more preferably sixty-five ksi; or most preferably eighty ksi. The high strength may provide sufficient erosion-resistance so that an outer surface of the body, head, and blades need not be hard-faced. Note that the steel may or may not be a High Strength Low Alloy Steel (HSLA) as designated by ASTM standards. A thickness 10*t* of the face 10*f* may be sufficient, such as greater than or equal to one inch or one and a half inches, to receive the nozzles 100. However, the thickness, strength/hardness, and/or ferrous nature of the head material may disqualify the casing bit 1 from being drillable by either a standard drill bit, such as a roller cone, diamond matrix, or PDC bit, or a similar casing bit such that a mill bit or hybrid mill-drill bit may be required to mill the casing bit 1 as opposed to simply drilling through the casing bit 1.

Alternatively, the blades 15*a,b* may be bonded or otherwise attached to the head 10, such as by welding, brazing, soldering, or using an adhesive. In this alternative, the blades may be made from a drillable material, such as a nonferrous metal or alloy (i.e., copper, brass, bronze, aluminum, zinc, tin, or alloys thereof), a polymer, or composite.

Figure 1A:
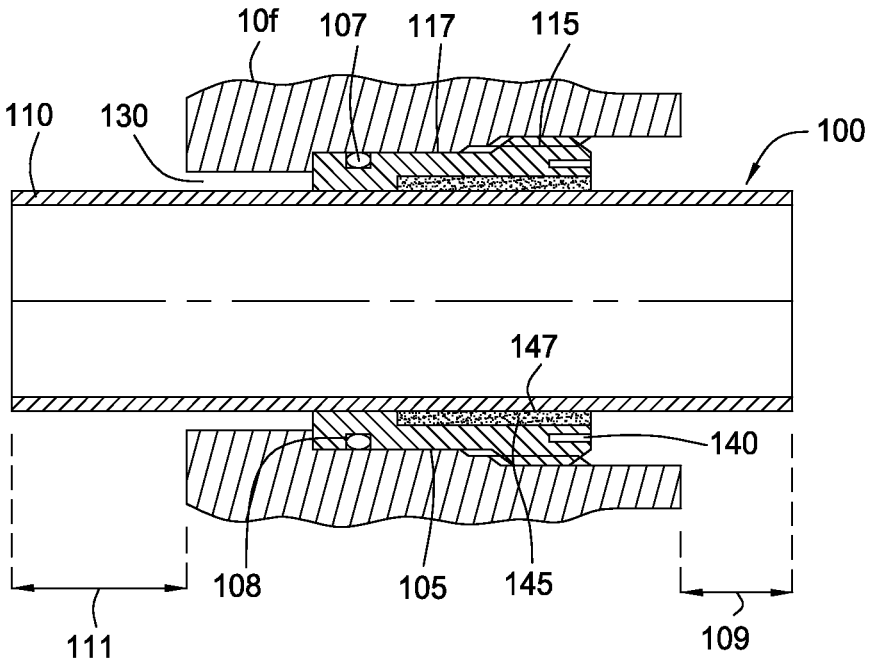
FIG. 1A is an enlarged cross-section of a nozzle of the casing bit.

FIG. 1A is an enlarged cross-section of the nozzle 100. The nozzle 100 may include a retainer 105 and a flow tube 110. The flow tube 110 may be made from an erosion resistant material, such as a ceramic or cermet (i.e., tungsten carbide). The flow tube 110 may be thin to facilitate drilling/milling of the flow tube 110. The flow tube 110 may have a substantially uniform inner diameter bore along its length to form a substantially straight bore through the flow tube 110. The substantially straight bore of the flow tube 110 may maintain a minimal thickness along the length of the flow tube 110, thus enhancing drillability/millability of the flow tube 110. The internal profile of the flow tube 110 formed by the substantially straight bore therethrough potentially decreases erosion of one or more portions of the nozzle 100 because the drilling fluid does not have to change direction due to obstructions within the bore when flowing through the nozzle 100.

The retainer 105 may be a tubular and made from a drillable material, such as a nonferrous metal or alloy (i.e., copper, brass, bronze, aluminum, zinc, tin, or alloys thereof), a polymer, or composite. The flow tube 110 may be mounted within the retainer 105. An inner surface of the retainer 105 may form a recess for receiving an adhesive 147, thereby bonding the flow tube 110 to the retainer. A surface of the face 10*f* defining the port 10*p* may form a profile 117 for receiving the retainer 105. An outer surface of the retainer 105 may have a seal groove 108 receiving a seal 107 for preventing fluid leakage across the interface formed between an outer surface of the retainer 105 and the profile 117. Alternatively, the seal groove 108 may be formed in an inner surface of the face 10*f*. The retainer 105 may be fastened to the face 10*f*, such as by a threaded connection 115. Alternatively, the retainer 105 may be fastened to the face 10*f* by a retainer clip or snap ring. The retainer 105 may include an installation and removal feature, such as slots 140.

Advantageously, fastening the retainer 105 to the face 10*f* instead of permanently bonding the retainer allows the nozzles 100 to be replaced at the drilling rig with a different size. In many instances, an optimum inside diameter of the nozzle 100 or flow tube 110 may not be determined until after the casing bit 1 has been delivered to the drilling rig.

Alternatively, the retainer 105 may be bonded to the face, such as by welding, brazing, or using an adhesive or solder. In this alternative, the casing bit 1 may be shipped to the rig and the optimum size flow tubes may be adhered to the retainers at the rig. Alternatively, the flow tube 110 may be bonded to the retainer 105, such as by welding, brazing, or soldering. Alternatively, the flow tube may be fastened to the retainer. Alternatively, the flow tube may be galled to the retainer and/or the retainer galled to the face by using an anti-lubricant, such as discussed and illustrated in U.S. Prov. App. No. 61/153,572, filed Feb. 18, 2009, which is herein incorporated by reference in its entirety.

The flow tube 110 may have a length greater than or equal to the retainer 105. If the length of the flow tube 110 is extended, the flow tube 110 may be positioned as desired within the retainer 105 to adjust an exit standoff 109 and entry standoff 111, thereby adjusting entry and exit points of the drilling fluid to minimize fluid erosion and/or to allow the exit point of the drilling fluid from the nozzle 100 to be positioned closer to the formation. The entry point may be adjusted to create a zone 130 in the drilling fluid flow where high velocities and turbulence do not exist, thereby protecting the relatively soft retainer 105 from erosion. Alternatively, the entry and exit points may be reversed.

Figure 1B:
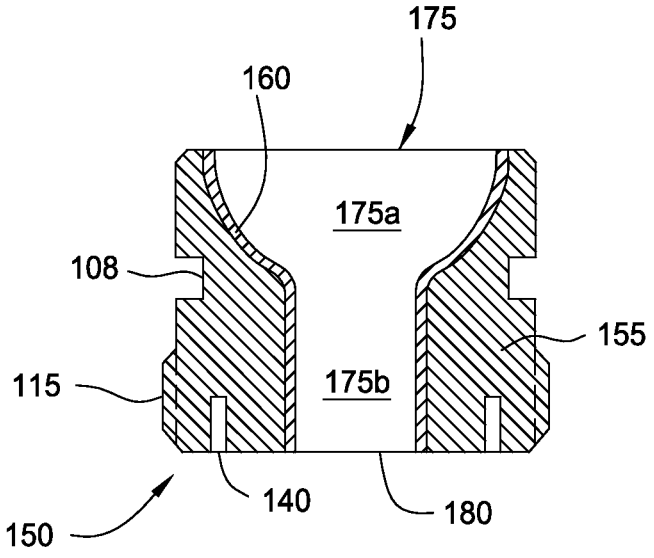
FIG. 1B is a cross-section of an alternative nozzle.

FIG. 1B is a cross-section of an alternative nozzle 150. The nozzle 150 may include an annular body 155. The body 155 may have a bore 175 formed therethrough with an inlet having a concave enlarged portion 175*a* which communicates with a cylindrical smaller diameter portion 175*b* leading to an outlet 180. The geometry of the through-bore 175 is such that drilling fluid is discharges at high velocity from the outlet 180.

An inner surface of the body 155 may be coated with an erosion-resistant material 160. The erosion-resistant material may be a metal or alloy, such as chrome, or a ceramic or cermet, such as tungsten carbide. To facilitate drill/mill through, the body 155 may be made from a drillable material (discussed above). If the coating 160 is chrome and the body is copper, the chrome may be deposited on the copper by electroplating.

Figure 2B:
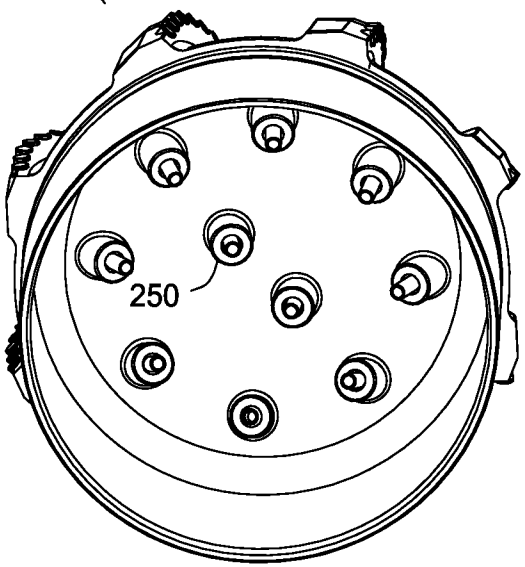
FIG. 2B is a rear end view of the head.
Figure 2A:
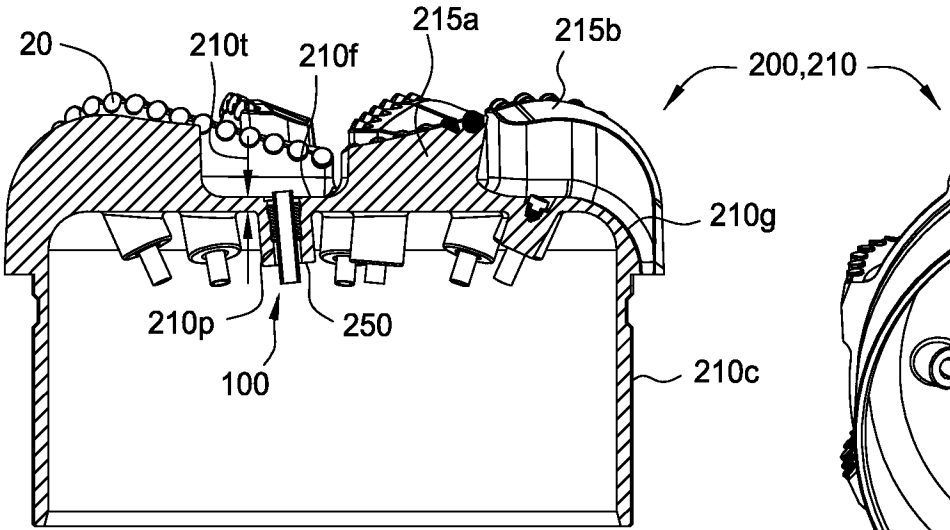
FIG. 2A is a cross-section of a head of a casing bit, according to another embodiment of the present invention.

FIG. 2A is a cross-section of a head 210 of a casing bit 200, according to another embodiment of the present invention. FIG. 2B is a rear end view of the head 210. The casing bit 200 may include a body (not shown), the head 210, one or more blades 215*a,b*, one or more cutters 20, one or more stabilizers (not shown), and one or more nozzles 100. As discussed above, the head 210 may include a threaded outer surface 210*c* for connection to the body. Alternatively, the head, blades, and body may be integrally formed, such as by casting.

The casing bit 200 may be similar to the casing bit 1 except that a nominal thickness 210*t* of the face has been substantially reduced relative to the thickness 10*t* so that the casing bit may be drilled through by a standard drill bit (discussed above) or another casing bit without substantial damage thereto. The thickness 210*t* may be less than or equal to one, three-quarters, one-half, or three-eighths of an inch. In order to accommodate the nozzles 100/150, a thickness of the face proximate to each of the ports 210*p* may be increased by a boss 250. Each boss 250 may be tubular and integrally formed with the head 210, such as by casting. Each boss 250 may extend from a rear surface of the face 210*f*. Each boss 250 may locally increase the face thickness to greater than or equal to one inch or one and one-half inches. In this manner, the substantial reduction in nominal thickness of the high strength steel correspondingly substantially increases the drillability of the casing bit and the bosses compensate the facial thickness only where needed to receive the nozzles without substantial penalty to the drillability of the casing bit 200.

Figure 3B:
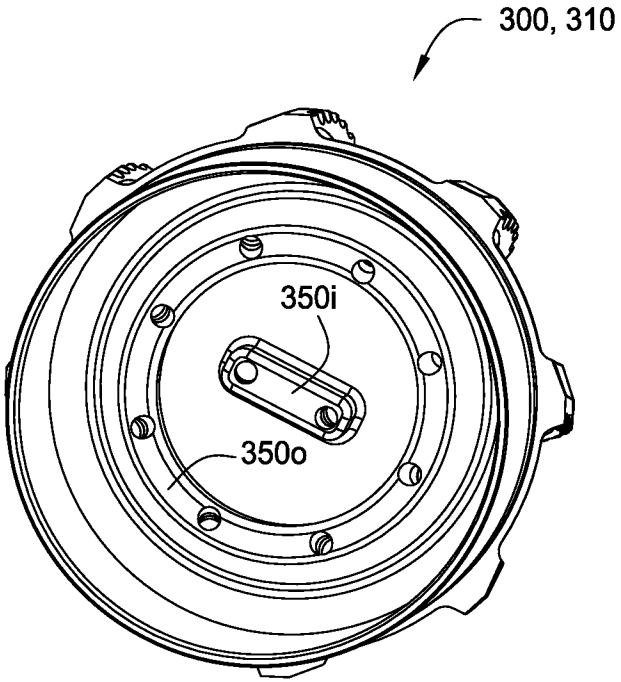
FIG. 3B is a rear end view of the head.
Figure 3A:
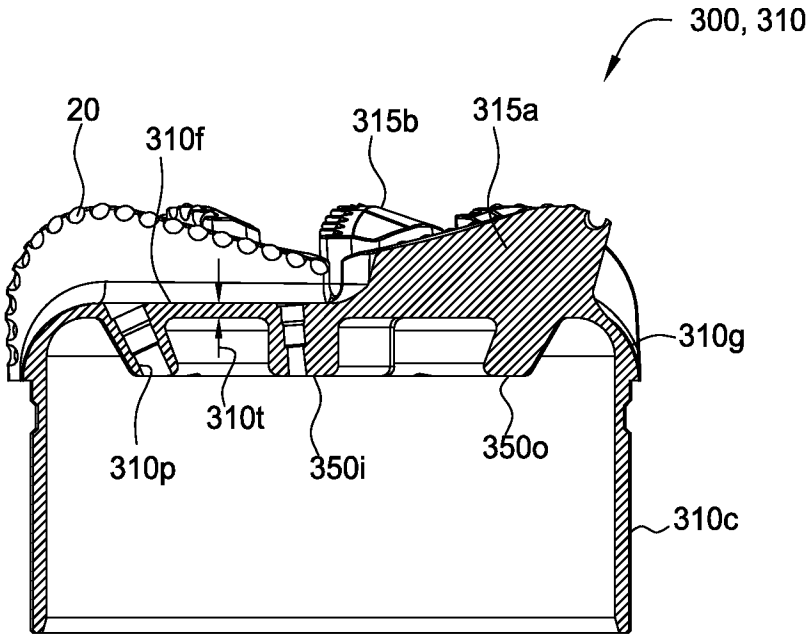
FIG. 3A is a cross-section of a head of a casing bit, according to another embodiment of the present invention.

FIG. 3A is a cross-section of a head 310 of a casing bit 300, according to another embodiment of the present invention. FIG. 3B is a rear end view of the head 310. The casing bit 300 may include a body (not shown), a head 310, one or more blades 315*a,b*, one or more cutters 20, one or more stabilizers (not shown), and one or more nozzles (not shown). As discussed above, the head 310 may include a threaded outer surface 310*c* for connection to the body. Alternatively, the head, blades, and body may be integrally formed, such as by casting.

The casing bit 300 may be similar to the casing bit 1 except that a nominal thickness 310*t* of the face 310*f* has been substantially reduced relative to the thickness 10*t* so that the casing bit may be drilled through by a standard drill bit (discussed above) or another casing bit without substantial damage thereto. The thickness 310*t* may be less than or equal to one, three-quarters, one-half, or three-eighths of an inch. In order to accommodate the nozzles 100/150, a thickness of the face 310*f* proximate to the ports 310*p* may be increased by a boss 350*i,o*. Each boss 350*i,o* may be integrally formed with the head 310, such as by casting. Each boss 350*i,o* may locally increase the face thickness to greater than or equal to one inch or one and one-half inches.

As compared to the casing bit 200, instead of individually increasing the facial thickness, an outer set of ports 310*p* may be radially aligned and the facial thickness increased by an outer boss ring 350*o*. Correspondingly, a boss block 350*i* may increase the facial thickness for an inner set of ports. Alternatively, the inner set of ports may include more than two ports and an inner boss ring may be used instead of the boss block to increase the facial thickness. As compared to the individual bosses 250, the bosses 350*i,o* may offer a continuous drill-through profile as compared to the individually arranged bosses 250. Even though the bosses 350*i,o* substantially increase a volume of the high strength material in the head 310, the bosses may still improve drillability relative to the bosses 250 as the individual bosses 250 may break free during drill-through, thereby hindering drill-through or even damaging the drill-through bit.

Figure 4A:
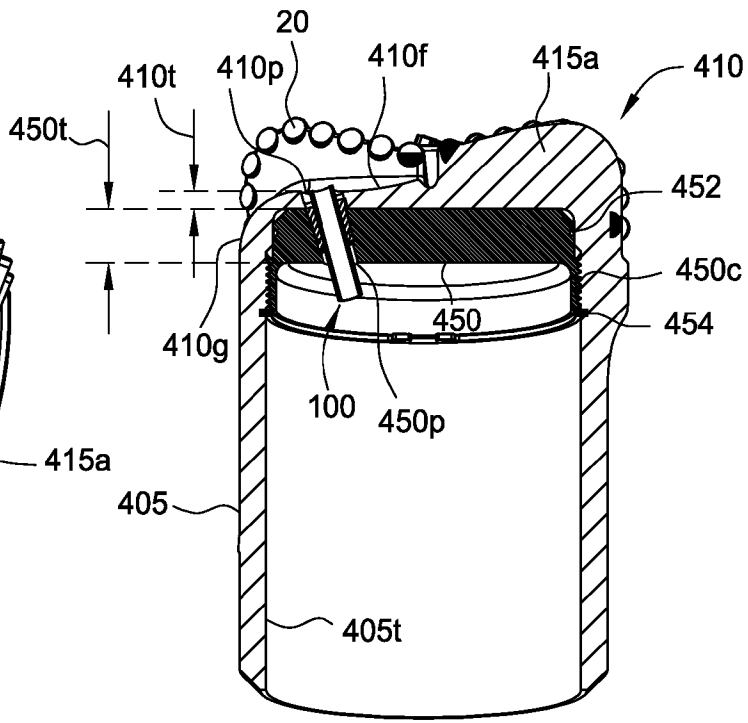
FIG. 4A is a cross section of a casing bit, according to another embodiment of the present invention.
Figure 4C:
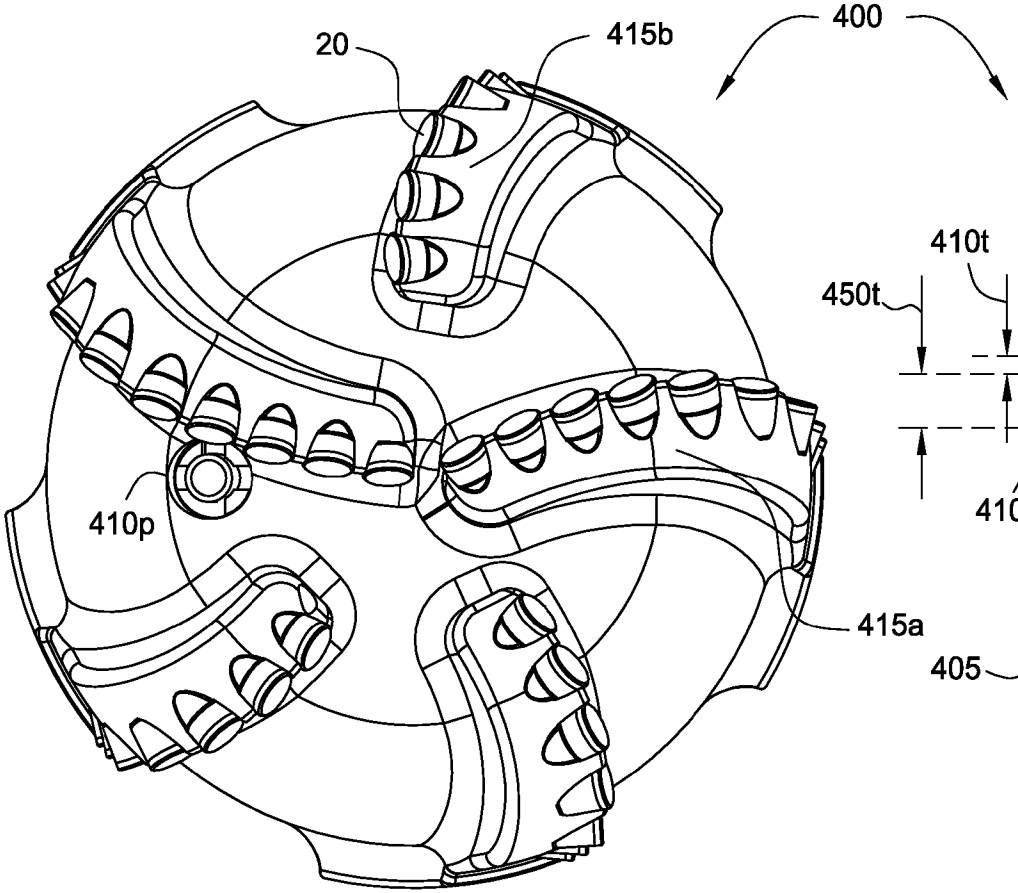
FIG. 4C is a front end view of a head of the casing bit.
Figure 4B:
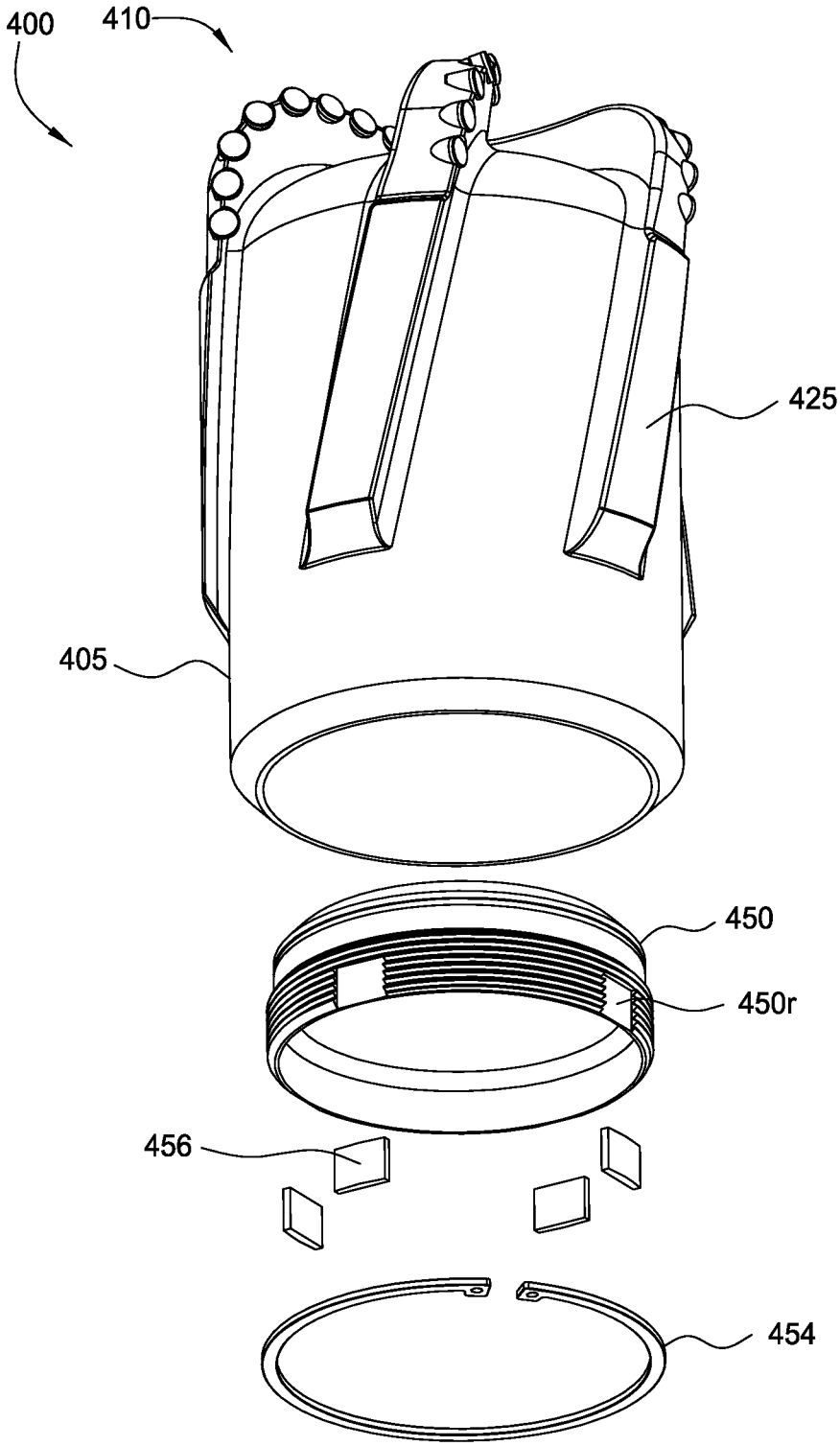
FIG. 4B is an exploded assembly of the casing bit.

FIG. 4A is a cross section of a casing bit 400, according to another embodiment of the present invention. FIG. 4B is an exploded assembly of the casing bit. FIG. 4C is an end view of the head of the casing bit. The casing bit 400 may include a body 405, a head 410, one or more blades 415*a,b*, one or more cutters 20, one or more stabilizers 425, a nozzle adapter 450, and one or more nozzles 100.

The casing bit 400 may be similar to the casing bit 1 except that a nominal thickness 410*t* of the face 410*f* has been substantially reduced relative to the thickness 10*t* so that the casing bit may be drilled through by a standard drill bit (discussed above) or another casing bit without substantial damage thereto. The thickness 410*t* may be less than or equal to one, three-quarters, one-half, or three-eighths of an inch. As compared to the casing bits 200,300, instead of increasing the facial thickness with bosses, the nozzle adapter 450 may be fastened to the head 410, such as by a threaded connection 450*c*, thereby longitudinally and rotationally coupling the nozzle adapter to the head. Alternatively, the nozzle adapter 450 may be coupled to the head by an interference fit, such as a press or shrink fit. Alternatively, the nozzle adapter 450 may have one or more splines or keys formed on an outer surface thereof in engagement with corresponding splines or keyways formed on an inner surface of the head, thereby rotationally coupling the head and the nozzle adapter, and may be longitudinally coupled to the head by one or more fasteners. The nozzle adapter 450 may be made from a drillable material, such as a nonferrous metal or alloy (i.e., copper, brass, bronze, aluminum, zinc, tin, or alloys thereof), a polymer, or a composite.

The nozzle adapter 450 may have a disk and a rim. The disk may have a thickness 450*t*. The thickness 450*t* may be sufficient to accommodate the nozzles 100, such as greater than or equal to one inch or one and one-half inches, or a combination of the facial thickness 410*t* and the nozzle adapter thickness 450*t* may be sufficient to accommodate the nozzles 100. The nozzle 100 may be disposed in the adapter port 450*p* and may extend into or through the face port 410*p*. Alternatively, the nozzle 100 may not extend into or through the face port 410*p*.

The nozzle adapter 450 may be further anchored to the head to facilitate drill-through. Each of the adapter thread and the head thread may have one or more recesses formed therein (only adapter recesses 450*r* shown). The nozzle adapter 450 may be screwed into the head until the connection 450*c* is tight and then the recesses 450*r* may be aligned. A key 456 may be inserted into each pair of aligned recesses, thereby ensuring that the nozzle adapter remains rotationally coupled to the head 410 during drill through. The keys 456 may be longitudinally kept with a fastener, such as a snap ring 454. Ports 410*p*, 450*p* may be formed through the face 410*f* and nozzle adapter 450 after the adapter is connected to the head 410. The adapter surface defining each port 450*p* may be threaded for fastening the nozzle retainer 105 thereto. The thread may or may not extend into the face 410*f*. To prevent leakage of drilling fluid through an interface between the nozzle adapter 450 and the head 410, a seal, such as an o-ring 452, may be disposed between the adapter and the head.

Alternatively, the nozzle adapter may be bonded to the head, such as by an adhesive, solder, weld, or braze or fastened with a different fastener, such as pins or set screws. Alternatively, the nozzle adapter may be galled to the head by using an anti-lubricant, such as discussed and illustrated in the '572 Provisional. Alternatively, the nozzle may be bonded to the nozzle adapter, such as by an adhesive, solder, weld, or braze. Alternatively, the nozzle may be galled to the nozzle adapter by using an anti-lubricant.

Figure 5A:
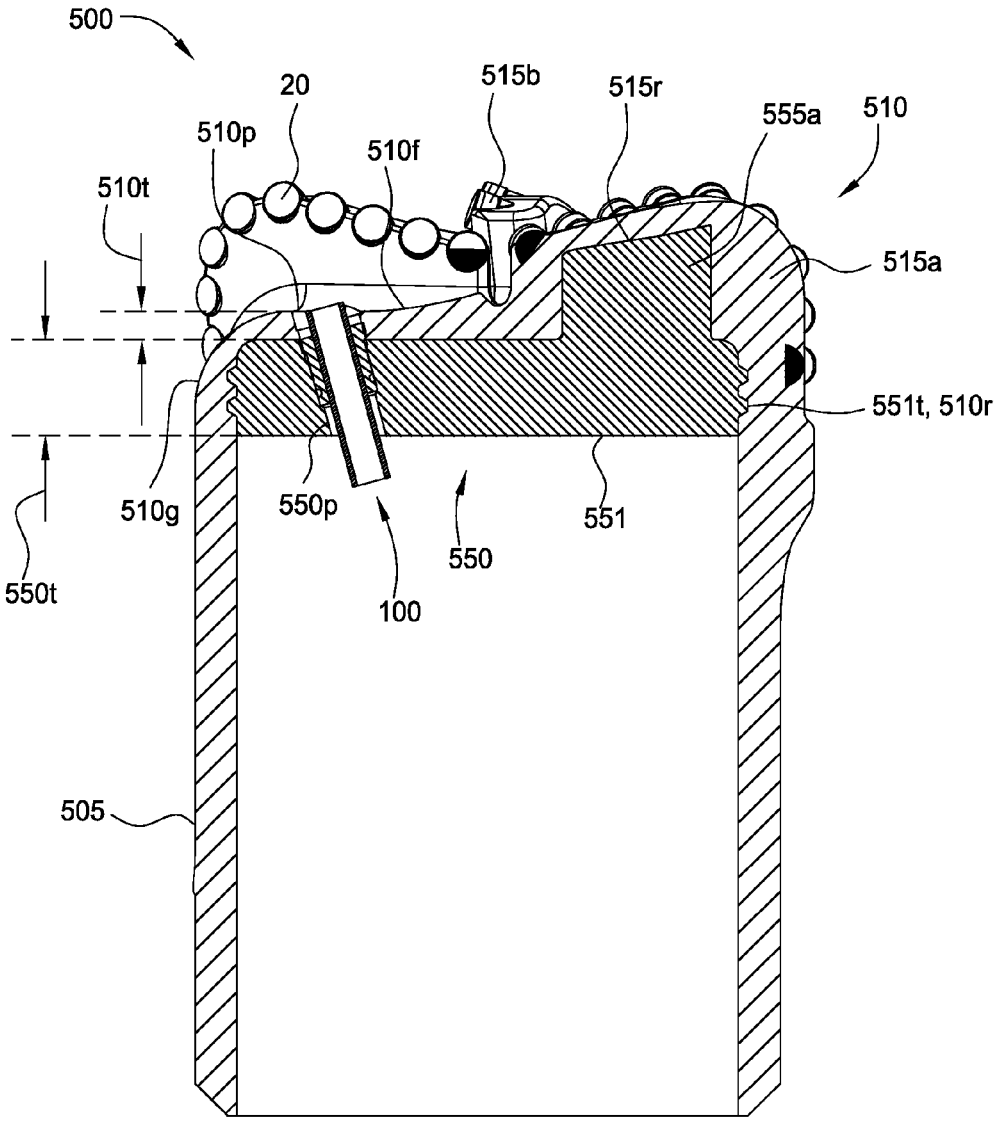
FIG. 5A is a cross section of a casing bit, according to another embodiment of the present invention.
Figure 5B:
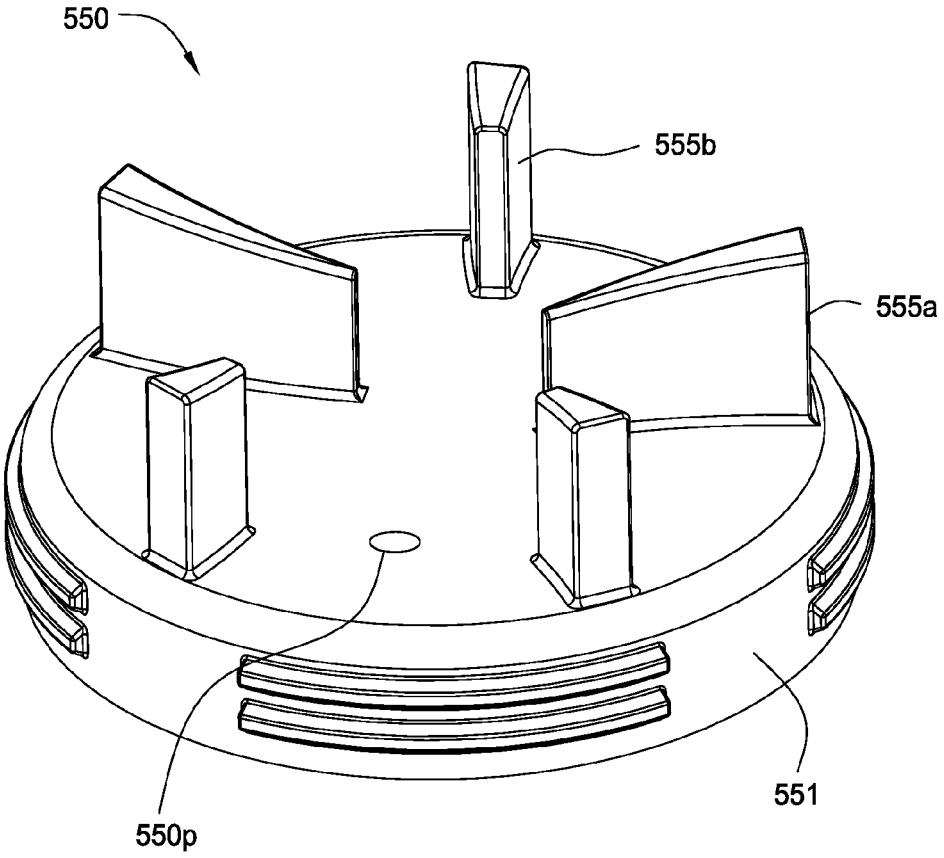
FIG. 5B is an isometric view of a nozzle adapter of the casing bit.

FIG. 5A is a cross section of a casing bit 500, according to another embodiment of the present invention. FIG. 5B is an isometric view of a nozzle adapter 550 of the casing bit 500. The casing bit 500 may include a body 505, a head 510, one or more blades 515*a,b*, one or more cutters 20, one or more stabilizers (not shown), a nozzle adapter 550, and one or more nozzles 100 (one shown).

The casing bit 500 may be similar to the casing bit 1 except that a nominal thickness 510*t* of the face 510*f* has been substantially reduced relative to the thickness 10*t* so that the casing bit may be drilled through by a standard drill bit (discussed above) or another casing bit without substantial damage thereto. The thickness 510*t* may be less than or equal to one, three-quarters, one-half, or three-eighths of an inch. The nozzle adapter 550 may have a disk 551 and one or more anchors 555*a,b*. The disk 551 may have a thickness 550*t*. The thickness 550*t* may be sufficient to accommodate the nozzles 100, such as greater than or equal to one inch or one and one-half inches, or a combination of the facial thickness 510*t* and the disk thickness 550*t* may be sufficient to accommodate the nozzles 100.

As compared to the casing bit 400, instead of screwing the nozzle adapter 450 into the head 410, the adapter 550 may be cast into the head 510 by using the head as a mold. The nozzle adapter 550 may be longitudinally and rotationally coupled to the head 510 by a locking profile 510*r* formed in the head. When the molten adapter material is poured into the head 510, a mating profile 551*t* may be formed. The profiles may include one or more rows of tabs 551*t* and grooves 510*r*, each row including one or more tabs and grooves, each tab/groove extending partially around the head/adapter. The nozzle adapter 550 may have the tabs 551*t* and the head 510 may have the grooves 510*r* or vice versa.

The nozzle adapter 550 may be made from a drillable material, such as a nonferrous metal or alloy (i.e., copper, brass, bronze, aluminum, zinc, tin, or alloys thereof), a polymer, or a composite. If the material is metallic, the head 510 may be inverted and the molten metallic material may be poured into the head. After cooling, any voids formed due to a different thermal expansion coefficient (TEC) between the head material and the adapter material may be filled by injecting a solidifying filler, such as a polymer, into an interface between the head and the nozzle adapter to prevent erosion due to leakage of drilling fluid. Once the nozzle adapter 550 and head 510 have cooled, the ports 510*p*,550*p* may be drilled and tapped and the nozzles 100 installed. If the adapter material is a polymer, liquid polymer may be injected into the head 510 and allowed to solidify. The ports 510*p*,550*p* may then be drilled and tapped and the nozzles 100 installed.

To further facilitate drillability, a recess 515*r* may be formed through the face 510*f* and into each blade 515*a,b*, thereby removing a substantial volume of the high strength material from the blades 515*a,b*. Casting/molding the nozzle adapter into the head may form the disk 551 and the one or more anchors 555*a,b*. Each recess 515*r* may be sized so as to not substantially weaken the respective blade 515*a,b*. The anchors 555*a,b* may rotationally couple the nozzle adapter to the head during drill-through. The anchors 555*a,b* may further serve to facilitate drillability by smoothing a drill-through path for the drill-through bit and by breaking chips of the casing bit 500 during drill through.

Figure 6A:
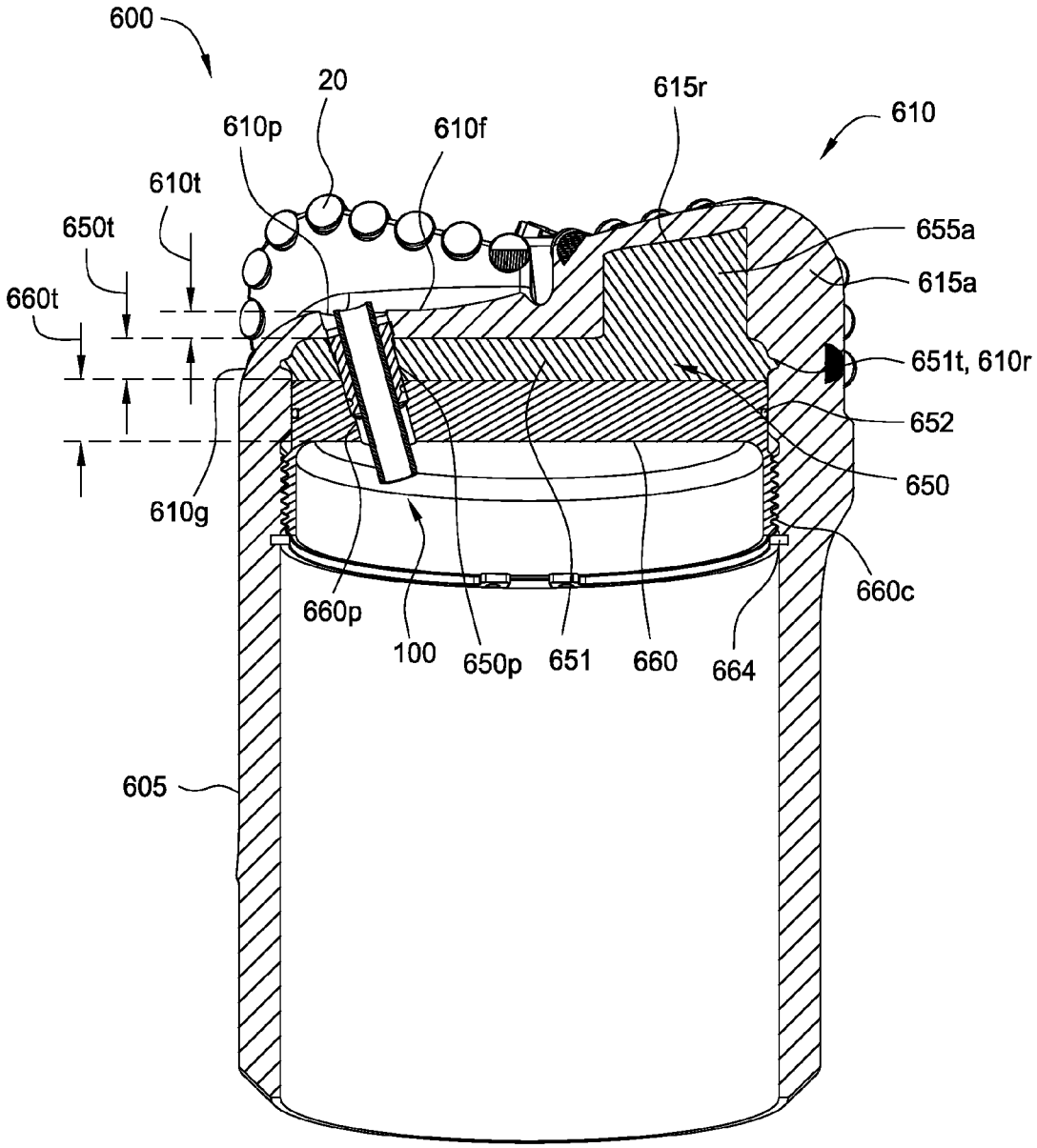
FIG. 6A is a cross section of a casing bit, according to another embodiment of the present invention.
Figure 6B:
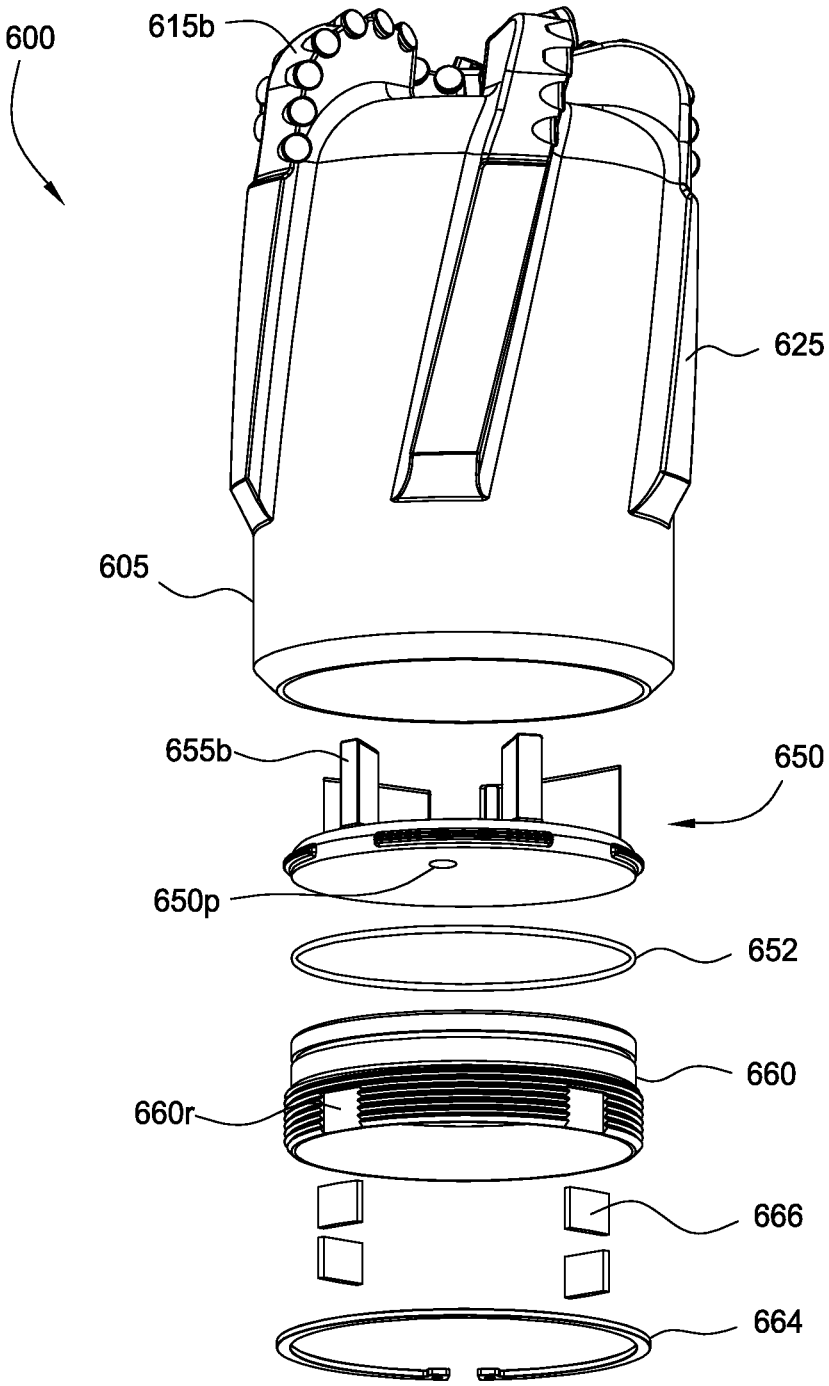
FIG. 6B is an exploded assembly of the casing bit.

FIG. 6A is a cross section of a casing bit 600, according to another embodiment of the present invention. FIG. 6B is an exploded assembly of the casing bit 600. The casing bit 600 may include a body 605, a head 610, one or more blades 615*a,b*, one or more cutters 20, one or more stabilizers 625, a nozzle adapter 650, a plug 660, and one or more nozzles 100.

The casing bit 600 may be similar to the casing bit 1 except that a nominal thickness 610*t* of the face 610*f* has been substantially reduced relative to the thickness 10*t* so that the casing bit may be drilled through by a standard drill bit (discussed above) or another casing bit without substantial damage thereto. The thickness 610*t* may be less than or equal to one, three-quarters, one-half, or three-eighths of an inch. The nozzle adapter 650 may have a disk 651 and one or more anchors 655*a,b*. The disk 651 may have a thickness 650*t*. The plug 660 may have a disk and a rim. The plug disk may have a thickness 660*t*.

The thicknesses 650*t*,660*t* may be sufficient to accommodate the nozzles 100, such as greater than or equal to one inch or one and one-half inches, or a combination of the facial thickness 610*t* and the adapter/plug thicknesses 650*t*,660*t* may be sufficient to accommodate the nozzles 100. Similar to the nozzle adapter 550, the adapter 650 may be cast/molded into the head 610 by using the head as a mold. The nozzle adapter 650 may be longitudinally and rotationally coupled to the head by the locking profile 651*t*,610*r*.

The plug 660 may be fastened to the head 610, such as by a threaded connection 660*c* thereby longitudinally and rotationally coupling the plug to the head. The plug 660 may be installed after the nozzle adapter 650 has cooled/solidified from casting/molding. The plug 660 may be further anchored to the head 610 to facilitate drill-through. Each of the plug thread and the head thread may have one or more recesses formed therein (only plug recesses 660*r* shown). The plug may be screwed into the head until the connection 660*c* is tight and then the recesses 660*r* may be aligned. A key 666 may be inserted into each pair of aligned recesses, thereby ensuring that the plug remains rotationally coupled to the head 610 during drill through. The keys 666 may be longitudinally kept with a fastener, such as a snap ring 664. Alternatively, the plug 660 may be bonded to the head 610, such as by an adhesive, solder, weld, braze, or galling. Each port 610*p*, 650*p*,660*p* may be formed through the face/adapter/plug after the plug is connected to the head. To prevent leakage of drilling fluid through an interface between the plug and the head, a seal, such as an O-ring 652, may be disposed between the plug and the head. A thickness of the nozzle adapter 650 may be selected so that the nozzle seal 107 engages the plug 660.

The nozzle adapter 650 and plug 660 may each be made from a drillable material, such as a nonferrous metal or alloy (i.e., copper, brass, bronze, aluminum, zinc, tin, or alloys thereof), a polymer, or a composite. The nozzle adapter and plug may be made from the same or different drillable material. As with the nozzle adapter 550, if the adapter 650 is metallic having a substantially different TEC, then voids may be formed upon cooling. Addition of the plug 660 provides a separate seal 652 negating risk of erosion of the nozzle adapter due to leakage of the drilling fluid.

Figure 7A:
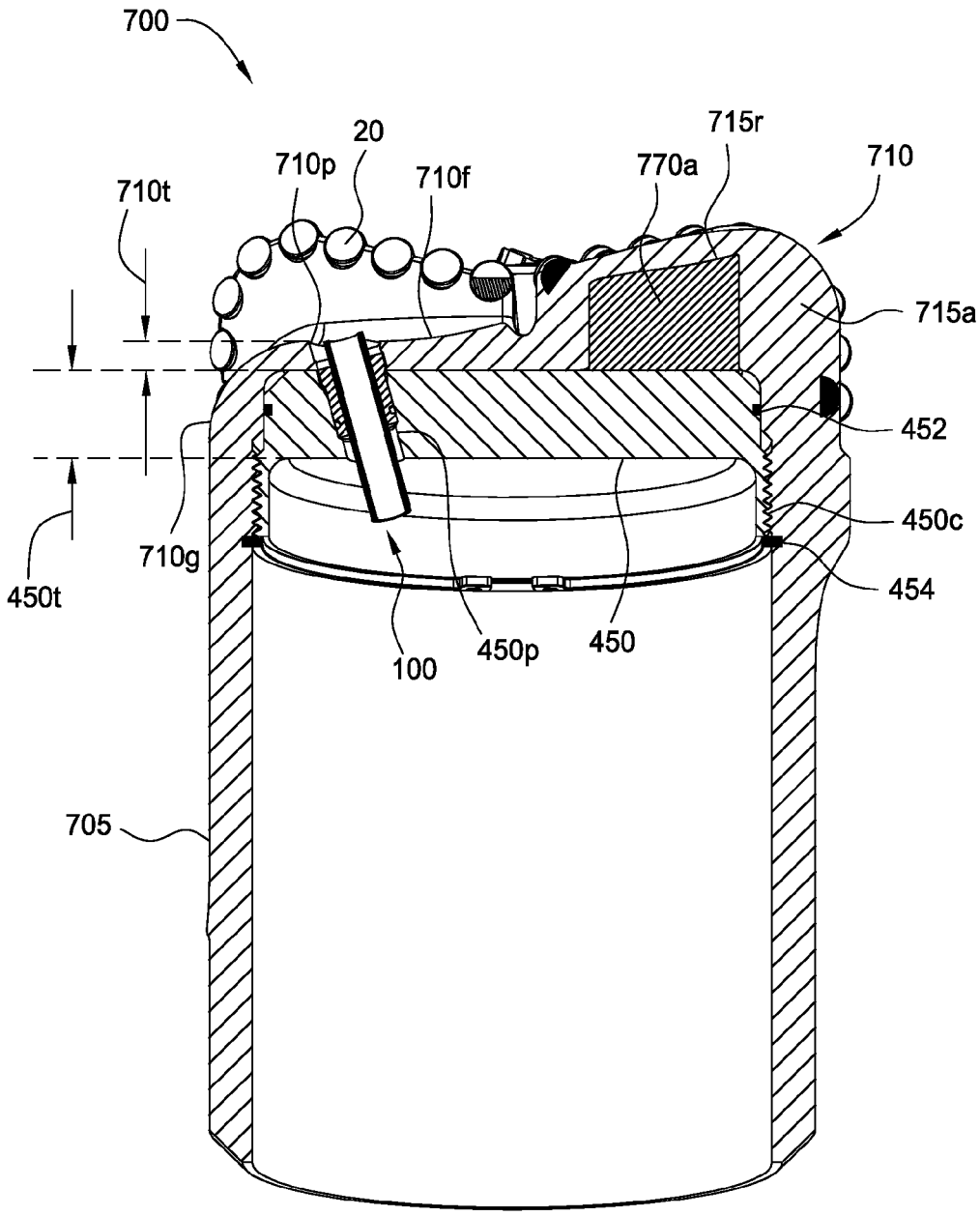
FIG. 7A is a cross section of a casing bit, according to another embodiment of the present invention.
Figure 7B:
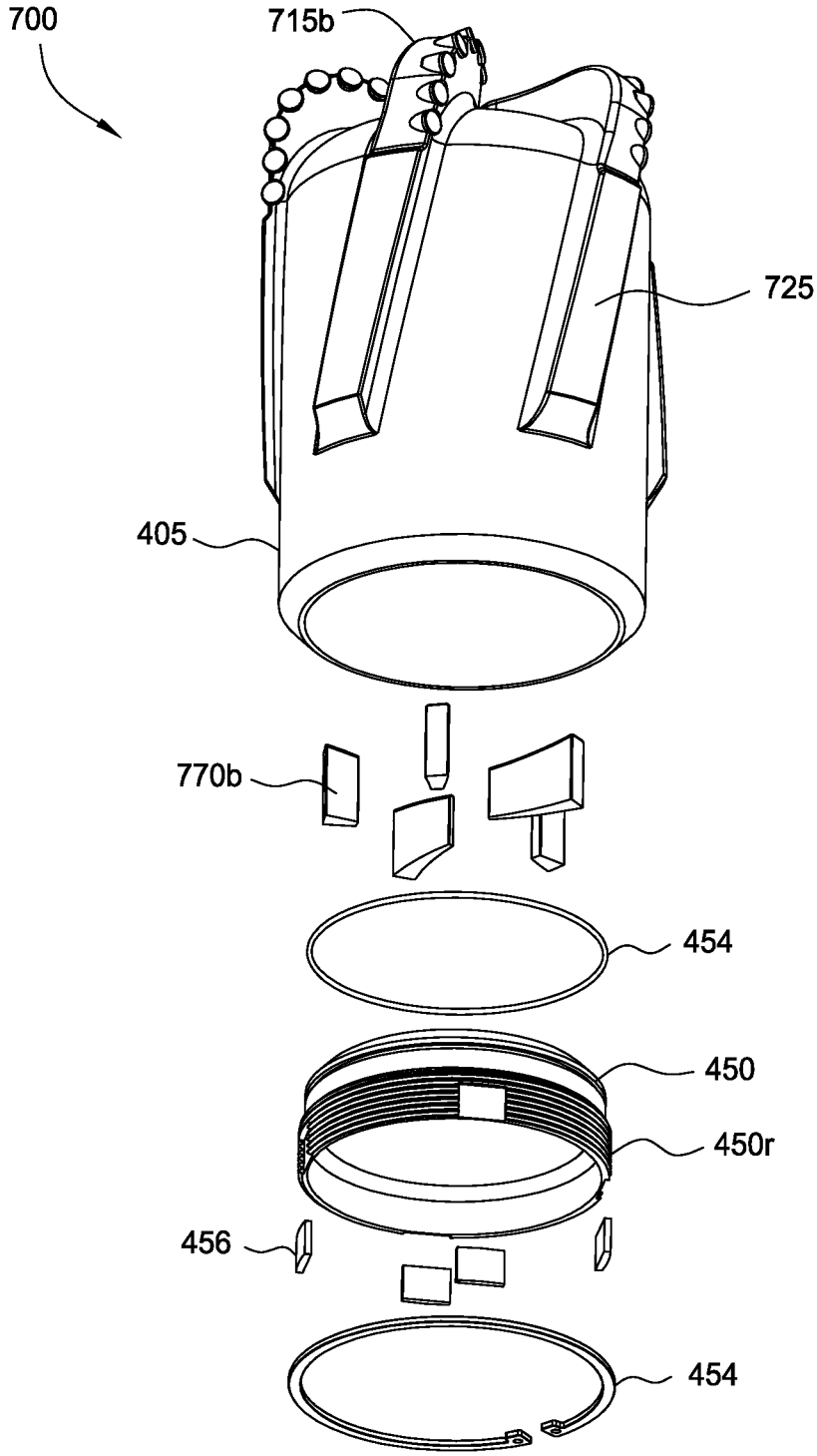
FIG. 7B is an exploded assembly of the casing bit.

FIG. 7A is a cross section of a casing bit 700, according to another embodiment of the present invention. FIG. 7B is an exploded assembly of the casing bit 700. The casing bit 700 may include a body 705, a head 710, one or more blades 715*a,b*, one or more cutters 20, one or more stabilizers 725, the nozzle adapter 450, and one or more nozzles 100.

The casing bit 700 may be similar to the casing bit 1 except that a nominal thickness 710*t* of the face 710*f* has been substantially reduced relative to the thickness 10*t* so that the casing bit may be drilled through by a standard drill bit (discussed above) or another casing bit without substantial damage thereto. The thickness 710*t* may be less than or equal to one, three-quarters, one-half, or three-eighths of an inch. The casing bit 700 may also be similar to the casing bit 400, except that a recess 715*r* may be formed in one or more of the blades 715*a,b*, thereby removing a substantial volume of the high strength material from the blades 715*a,b*. Each recess 715*r* may extend through the face 710*f* and into each blade 715*a,b* so that an insert 770*a,b* may be placed in a respective recess before installation of the nozzle adapter 450. The inserts 770*a,b* may then be retained in the blade recesses 715*r* by the nozzle adapter. Each recess 715*r* may be sized so as to not substantially weaken the respective blade 715*a,b*. The inserts 770*a,b* may be made from one of the drillable materials discussed above for the nozzle adapter 450 (the same or different from the selected drillable material for the adapter). Alternatively, the inserts 770*a,b* may be omitted.

Figure 8A:
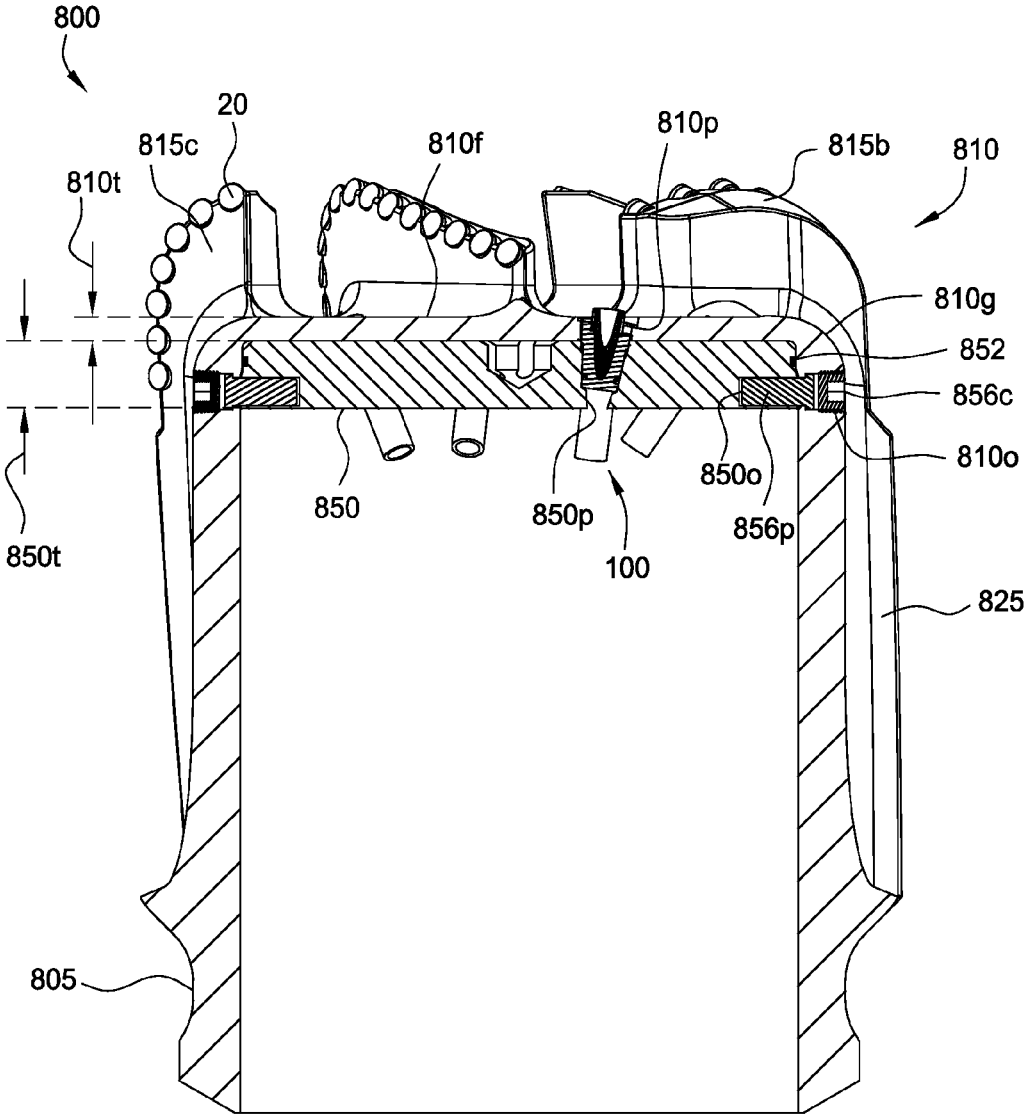
FIG. 8A is a cross section of a casing bit, according to another embodiment of the present invention.
Figure 8B:
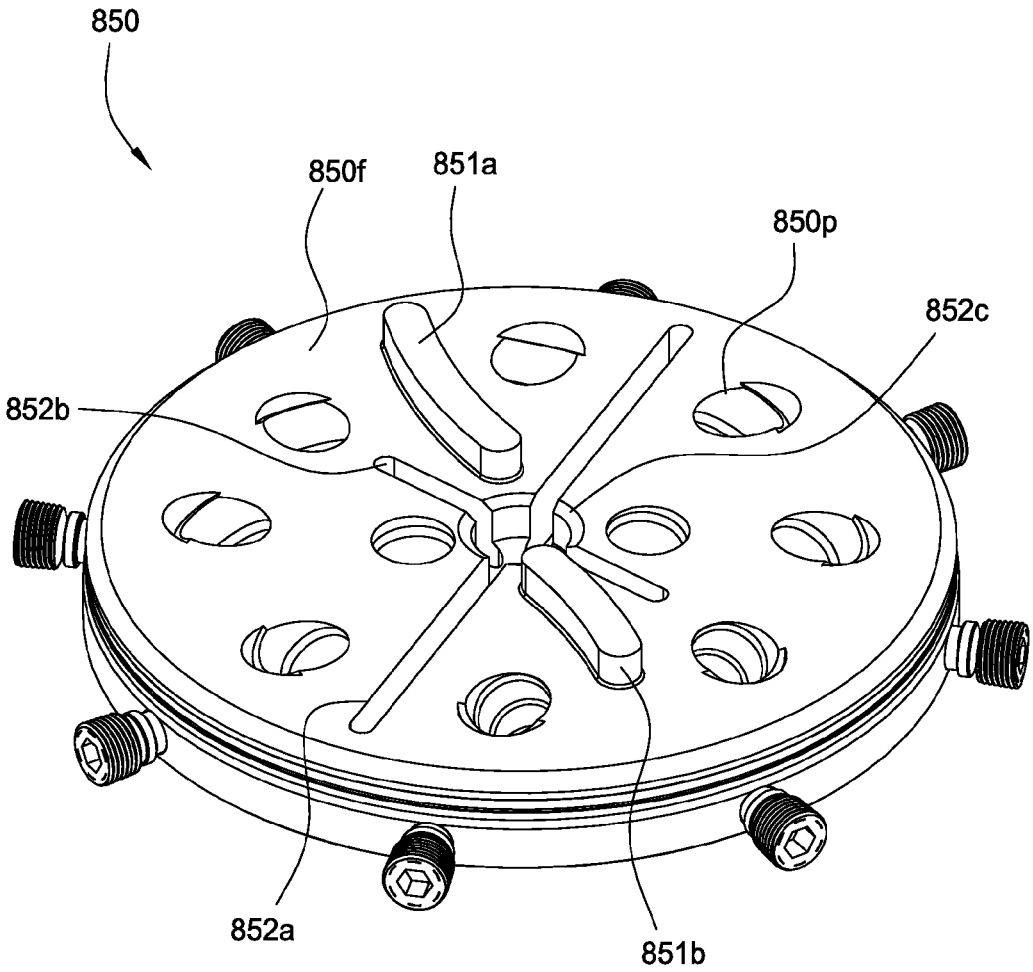
FIG. 8B is an isometric view of a nozzle adapter of the casing bit.
Figure 8C:
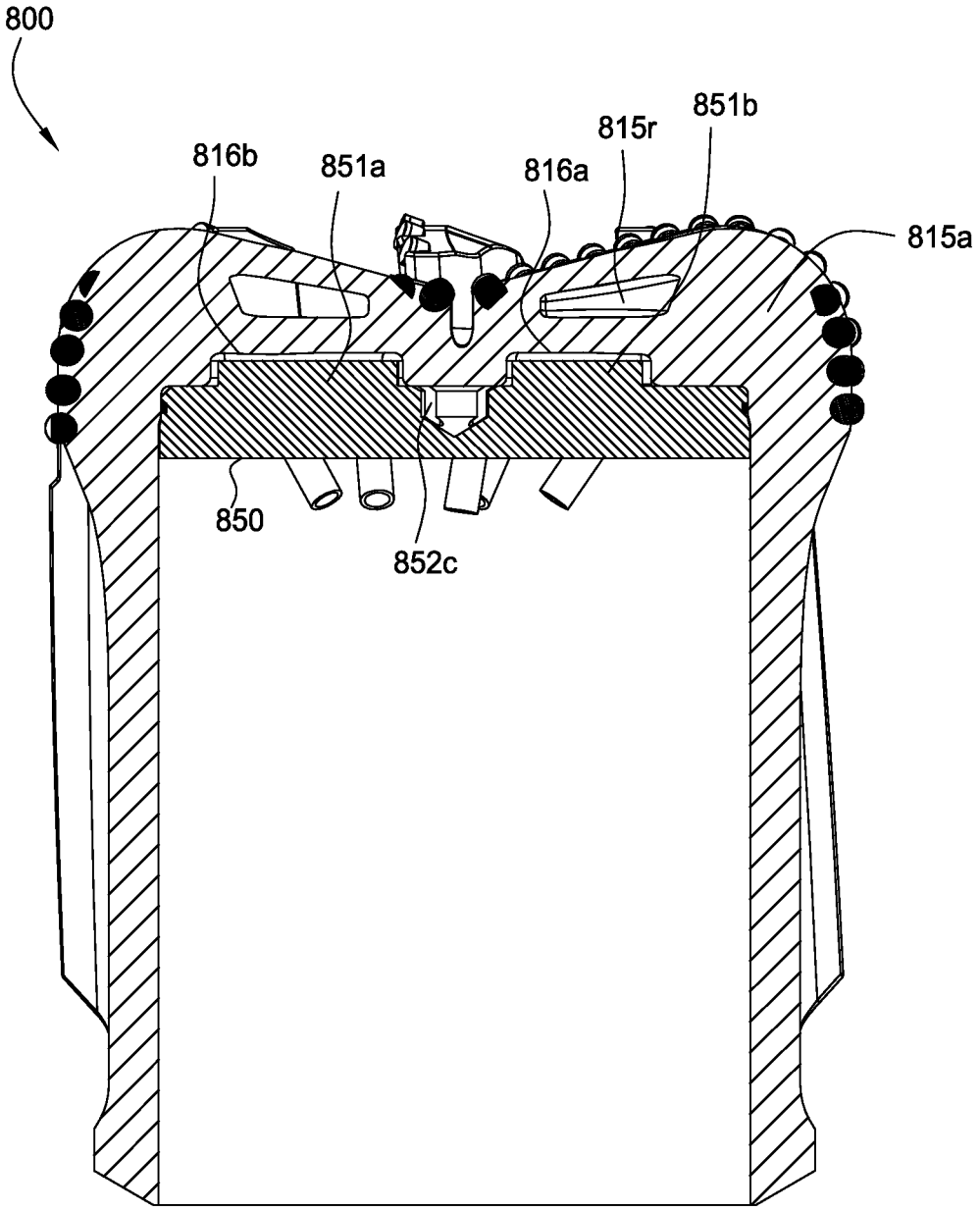
FIGS. 8C and 8D are other cross sections of the casing bit.
Figure 8D:
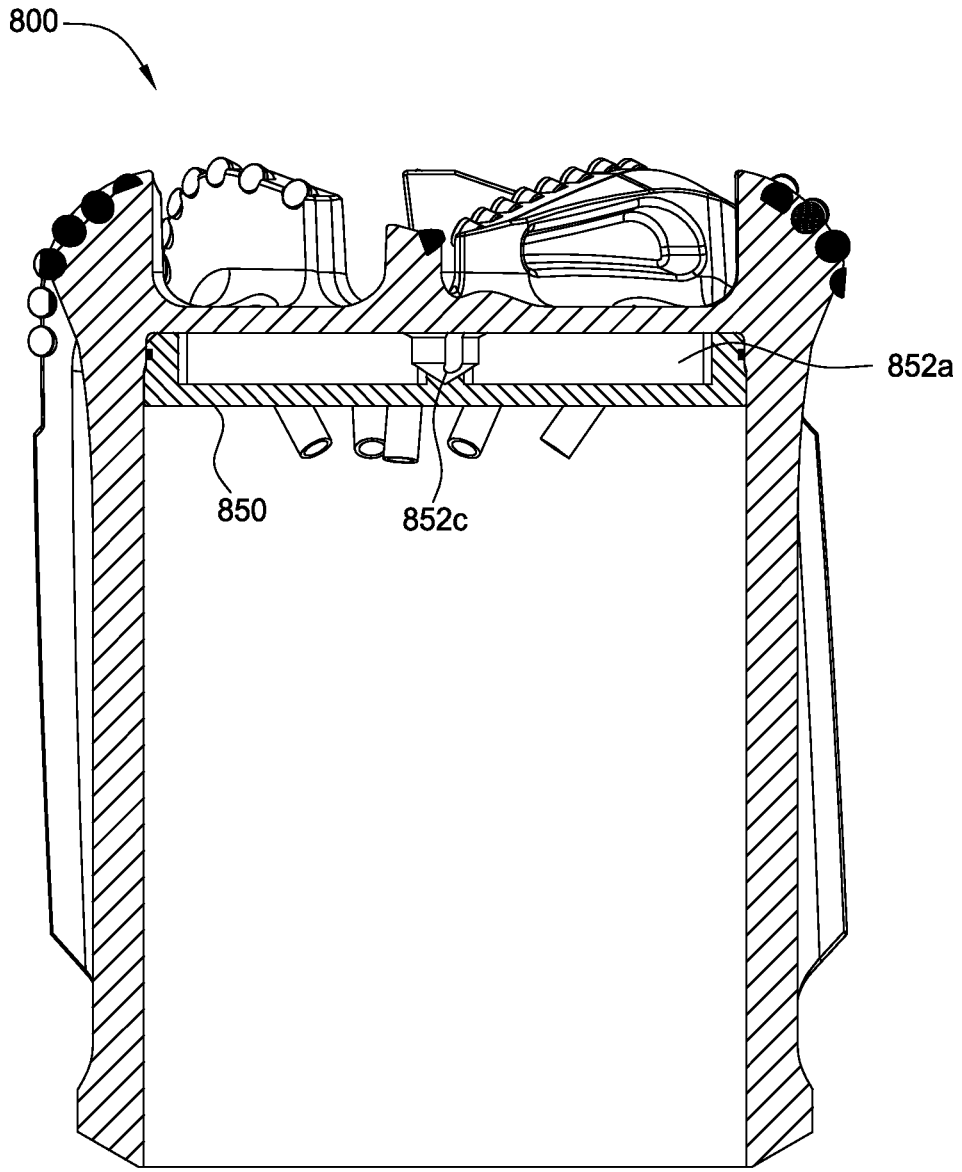
Figure 8E:
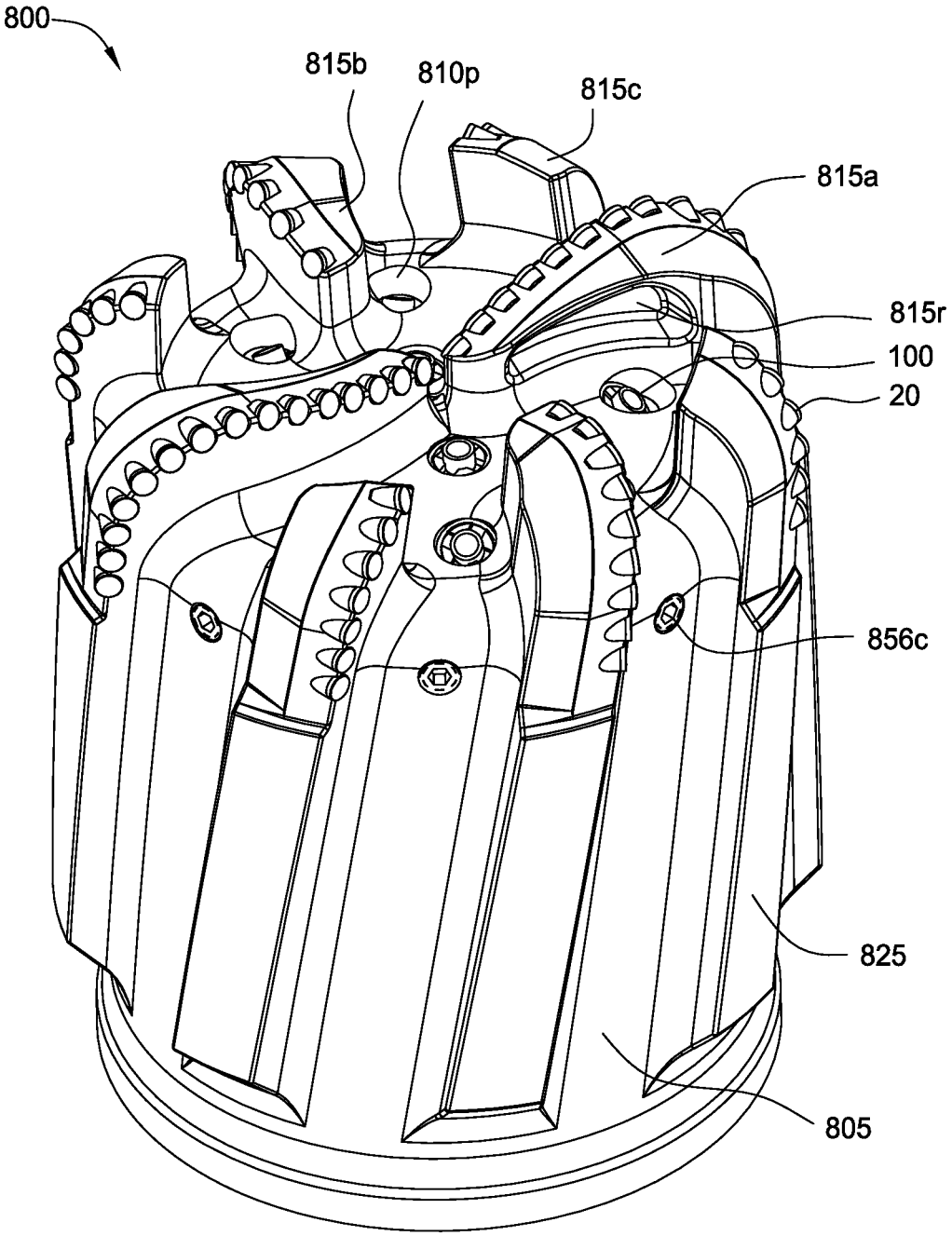
FIG. 8E is an isometric view of the casing bit.
Figure 8F:
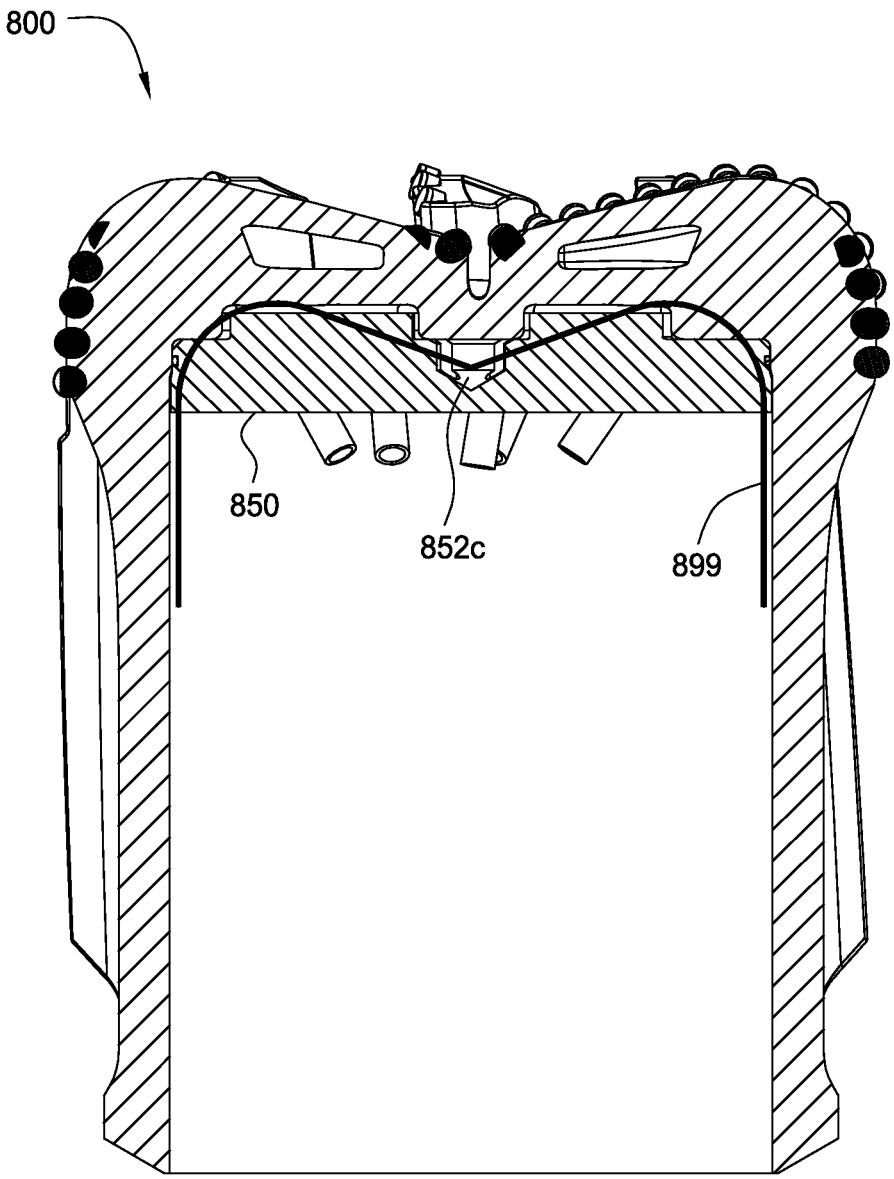
FIG. 8F illustrates an outline of a drill-through bit superimposed on the casing bit.
Figure 8G:
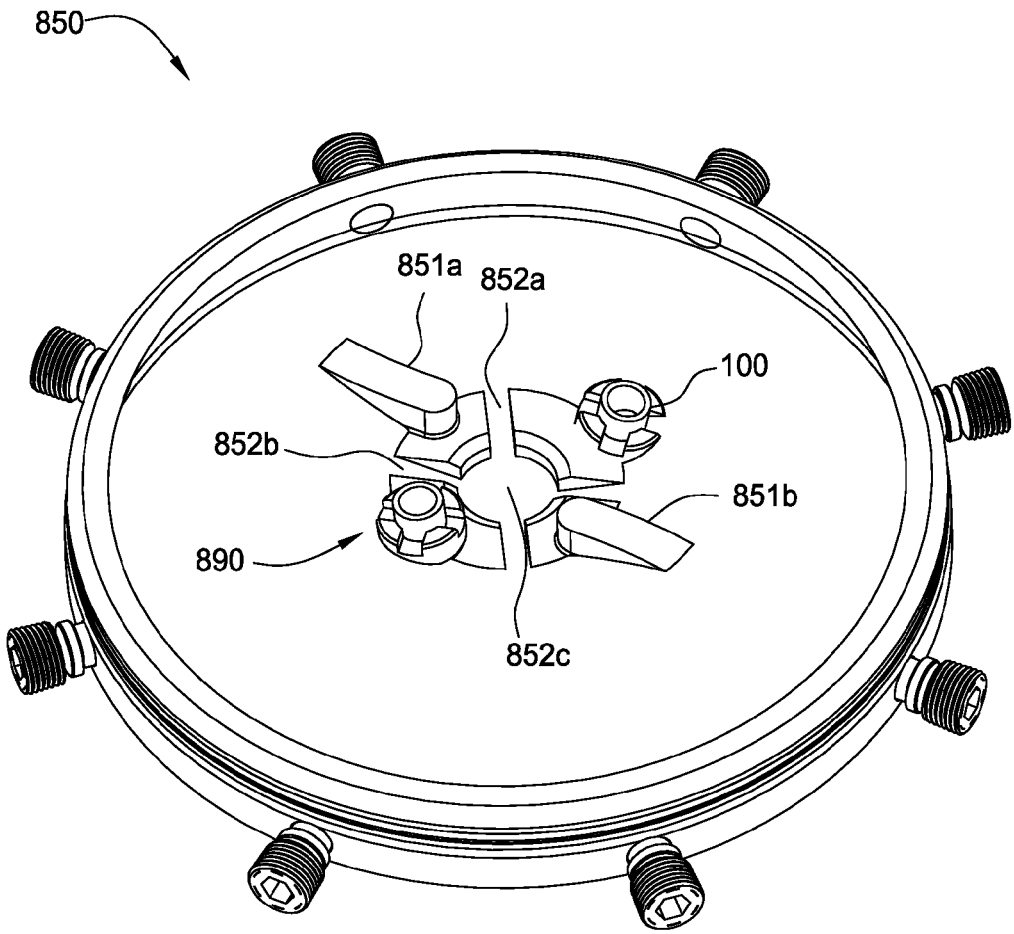

FIG. 8A is a cross section of a casing bit 800, according to another embodiment of the present invention. FIG. 8B is an isometric view of a nozzle adapter 850 of the casing bit 800. FIGS. 8C and 8D are other cross sections of the casing bit 800. FIG. 8E is an isometric view of the casing bit 800. FIG. 8F illustrates an outline of a drill-through bit 899 superimposed on the casing bit. FIG. 8G illustrates the nozzle adapter after being substantially drilled-through. The casing bit 800 may include a body 805, a head 810, one or more blades 815*a-c*, one or more cutters 20, one or more stabilizers 825, a nozzle adapter 850, and one or more nozzles 100.

The casing bit 800 may be similar to the casing bit 1 except that a nominal thickness 810*t* of the face 810*f* has been substantially reduced relative to the thickness 10*t* so that the casing bit 800 may be drilled through by a standard drill bit (discussed above) or another casing bit without substantial damage thereto. The thickness 810*t* may be less than or equal to one, three-quarters, one-half, or three-eighths of an inch. The nozzle adapter 850 may be fastened to the head 810, such as by one or more pins 856*p*. Each pin 856*p* may be inserted into an opening 810*o* formed through the side 810*g* until a head of the pin seats against a shoulder of the opening. A shank of the pin 856*p* may extend through the opening 810*o* and into an aligned opening 850*o* formed in the outer surface of the nozzle adapter 850. The pin 856*p* may be retained by screwing a threaded cap 856*c* into a threaded portion of the side opening 810*o*. The nozzle adapter 850 may be made from a drillable material, such as a nonferrous metal or alloy (i.e., copper, brass, bronze, aluminum, zinc, tin, or alloys thereof), a polymer, or a composite. The pins 856*p* may also be made from one of the drillable materials (the same as or different from the selected material for the adapter).

The nozzle adapter 850 may have a disk and one or more anchors 851*a,b*. The nozzle adapter disk may have a thickness 850*t*. The thickness 850*t* may be sufficient to accommodate the nozzles 100, such as greater than or equal to one inch or one and one-half inches, or a combination of the facial thickness 810*t* and the adapter thickness 850*t* may be sufficient to accommodate the nozzles 100. A seal, such as an o-ring 852, may be disposed between the nozzle adapter 850 and the head 810. Ports 810*p*, 850*p* may be formed through the face 810*f* and nozzle adapter 850 after the adapter is connected to the head 810. The port 850*p* may be threaded for fastening the nozzle retainer 105 thereto. The thread may or may not extend into the face 810*f*.

The nozzle adapter 850 may be further anchored to the head 810 to facilitate drill-through. The anchors may be tabs 851*a,b* formed on a front surface 850*f* of the adapter disk. The tabs 851*a,b* may each extend from near a center of the adapter disk radially outward proximately to at least a midpoint of a radius of the disk. A recess 816*a,b* may be formed in/through the face 810*f* underneath each of the blades 815*a* for receiving a respective tab 851*a,b*. A depth of the recesses 816*a,b* may be substantially equal to the facial thickness 810*t*. Engagement of the tabs 851*a,b* with the recesses 816*a,b* may ensure that the nozzle adapter 850 remains rotationally coupled to the head 810 during drill through. A length or other dimension of one of the tabs 851*a,b* may be different than the other of the tabs to ensure a specific rotational alignment of the nozzle adapter 850 with the head 810, thereby allowing the adapter ports 850*p* to be drilled and tapped before installation of the nozzle adapter 850 in the head 810 for instances where the nozzle distribution is asymmetric.

The nozzle adapter 850 may further have one or more chip-breakers 852*a-c*. The chip-breakers may include one or more first slots 852*a* formed in the front surface 850*f* of the adapter disk and extending from near a center of the disk radially outward nearly to an outer surface of the disk. The chip-breakers 852*a-c* may further include one or more second slots 852*b* formed in the front surface 850*f* and extending from near a center of the adapter disk radially outward proximately to a midpoint of a radius of the disk. The slots 852*a,b* may have a depth being a substantial fraction of the thickness 850*t*, such as greater than or equal to one-half or three-quarters. A longitudinal axis of the first slots 852*a* may be perpendicular to a longitudinal axis of the second slots 852*b*. The chip-breakers 852*a-c* may further include an opening 852*c* formed in the front surface 850*f* and at the center of the adapter disk. A depth of the opening 852*c* may be substantially equal to the depth of the slots 852*a,b*. A diameter of the opening 852*c* may be a small fraction of a diameter of the adapter disk, such as one-tenth. The slots 852*a,b* may extend from the opening 852*c*.

The chip-breakers 852*a-c* may ensure that debris 890 of the nozzle adapter 850 created due to a profile 899 of the drill-through bit is manageable by fracturing the adapter into a predetermined number of pieces, such as into quadrants. The tabs 851*a,b* may work in conjunction with the chip-breakers 852*a-c* by rotationally coupling one or more pieces of debris 890 and the head 810 after the chip-breakers 852*a-c* have separated the adapter 850 into debris 890. Tabs 851*a,b* may not be provided for each quadrant of the debris if nozzles 100 are disposed in the quadrant proximate to the adapter center, thereby serving as anchors for the particular quadrant.

To further facilitate drillability, a recess 815*r* may be formed in each of the blades 815*a*, thereby removing a substantial volume of the high strength steel from the blades 815*a* without substantially weakening the blades. The recess 815*r* may be formed in an exterior surface of each blade 815*a*, such as a side opposite to a side having the cutters 20. The recesses 815*r* may be in fluid communication with an outlet or exit point of one or more of the nozzles 100, thereby creating turbulence in the drilling fluid discharged from the nozzles 100 during drilling with the casing bit 800 and facilitating cooling and cleaning of the blades 815*a*. The turbulence may also alleviate balling of the casing bit in sticky formations. The turbulence may also allow for a reduction in blade height.

Figure 9:
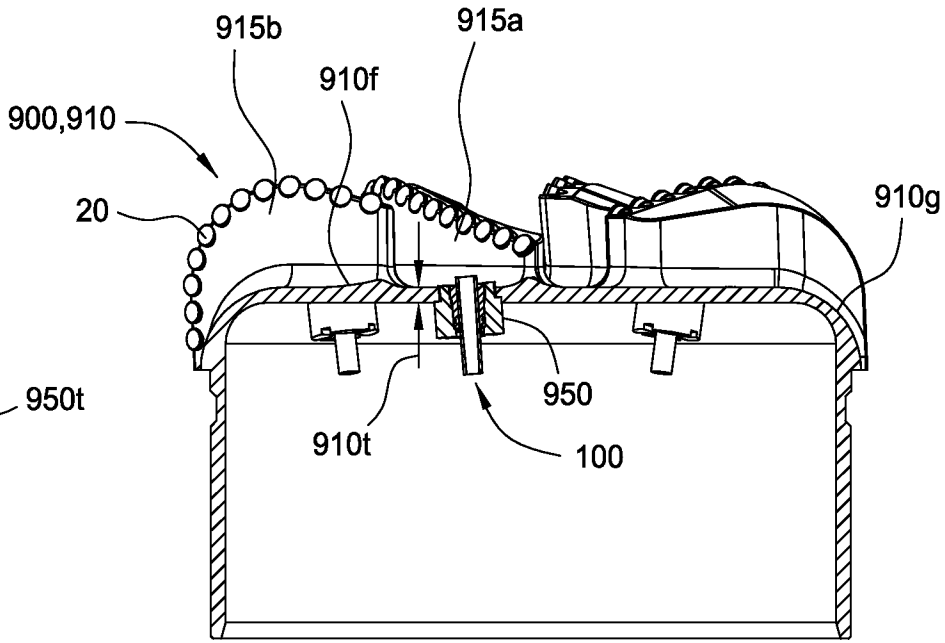
FIG. 9 is a cross section of a casing bit, according to another embodiment of the present invention.
Figure 9A:
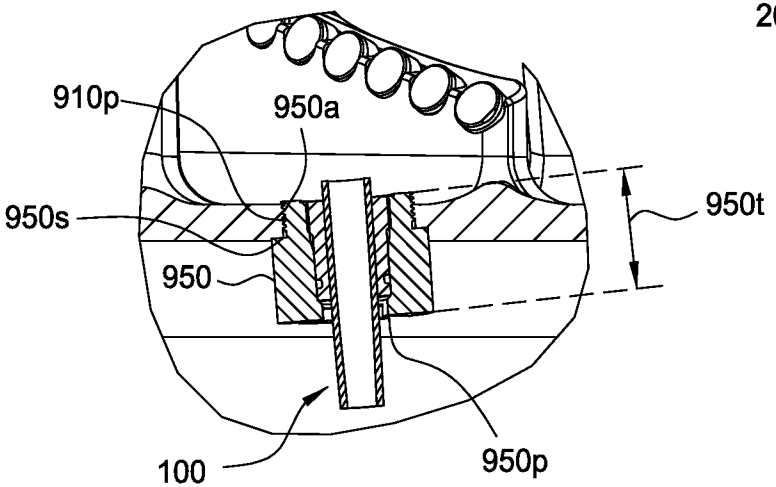
FIG. 9A is an enlargement of a portion of FIG. 9.

FIG. 9 is a cross section of a casing bit 900, according to another embodiment of the present invention. FIG. 9A is an enlargement of a portion of FIG. 9. The casing bit 900 may include a body (not shown), a head 910, one or more blades 915*a,b*, one or more cutters 20, one or more stabilizers (not shown), one or more nozzle adapters 950, and one or more nozzles 100.

The casing bit 900 may be similar to the casing bit 1 except that a nominal thickness 910*t* of the face 910*f* has been substantially reduced relative to the thickness 10*t* so that the casing bit may be drilled through by a standard drill bit (discussed above) or another casing bit without substantial damage thereto. The thickness 910*t* may be less than or equal to one, three-quarters, one-half, or three-eighths of an inch. Each nozzle adapter 950 may be made from a drillable material, such as a nonferrous metal or alloy (i.e., copper, brass, bronze, aluminum, zinc, tin, or alloys thereof), a polymer, or a composite.

Each nozzle adapter 950 may be annular and have a thickness 950*t*. The thickness 950*t* may be sufficient to accommodate a respective nozzle 100, such as greater than or equal to one inch or one and one-half inches. Each nozzle adapter 950 may be fastened to the face 910*f*, such as by a threaded connection 910*p*, 950*a*, thereby longitudinally and rotationally coupling the nozzle adapter to the head. An outer surface of each nozzle adapter 950 may be tapered from a larger outer diameter to a smaller outer diameter and form a shoulder 950*s* between the two diameters. The smaller diameter of the nozzle adapter may be threaded 950*a*. The shoulder 950*s* may abut an inner surface of the face 910*f* or a profile may be formed in an inner surface of the face for receiving the adapter. Ports 910*p*, 950*p* may be formed through the face 910*f* and nozzle adapter 950 before the adapter is connected to the head 910. The port 950*p* may also be threaded for fastening the nozzle retainer 105 thereto. Each adapter 950 may be fastened to the face from inside the head 910. The threaded connection between the nozzle retainer 105 and the nozzle adapter 950 may be opposite-handed from the threaded connection between the nozzle adapter and the face. The nozzle may then be fastened to the nozzle adapter from an exterior of the head.

Alternatively, the nozzle retainer 105 may be omitted and each flow tube 110 may be adhered to the respective nozzle adapter 950. Alternatively, each nozzle adapter 950 may be coupled to the head by an interference fit, such as a press or shrink fit. Alternatively, each nozzle adapter may be bonded to the head, such as by an adhesive, solder, weld, or braze. Alternatively, the nozzle adapter may be galled to the head by using an anti-lubricant, such as discussed and illustrated in the '572 Provisional.

Figure 10:
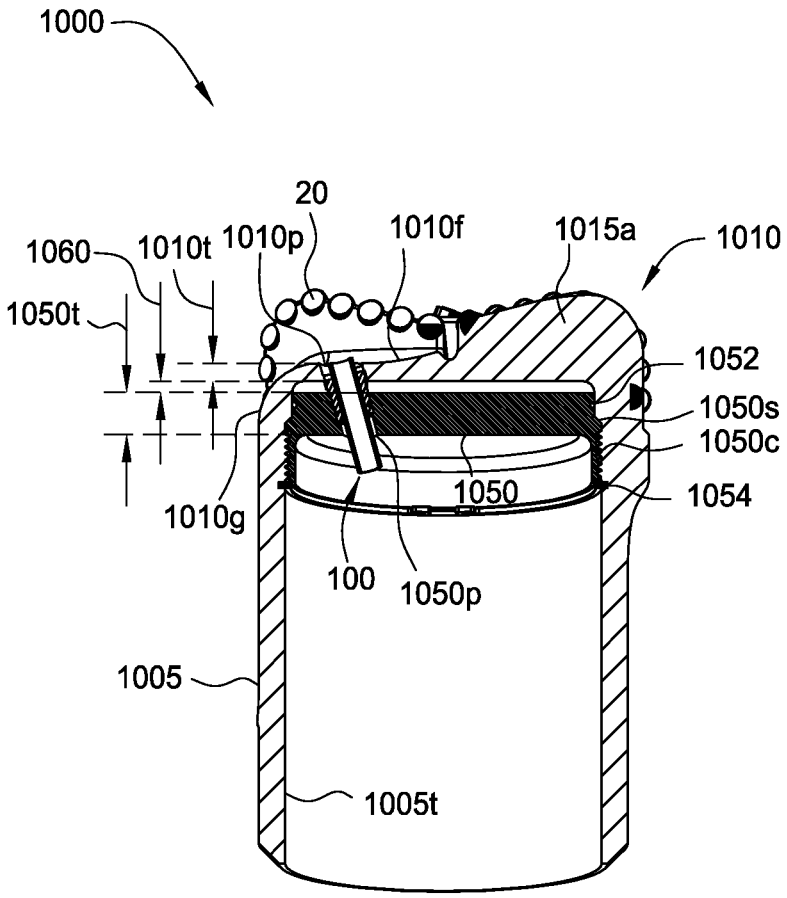
FIG. 10 is a cross section of a casing bit, according to another embodiment of the present invention.

FIG. 10 is a cross section of a casing bit 1000, according to another embodiment of the present invention. The casing bit 1000 may include a body 1005, a head 1010, one or more blades 1015*a*, one or more cutters 20, one or more stabilizers (not shown), a nozzle adapter 1050, and one or more nozzles 100.

The casing bit 1000 may be similar to the casing bit 1 except that a nominal thickness 1010*t* of the face 1010*f* has been substantially reduced relative to the thickness 10*t* so that the casing bit may be drilled through by a standard drill bit (discussed above) or another casing bit without substantial damage thereto. The thickness 1010*t* may be less than or equal to one, three-quarters, one-half, or three-eighths of an inch. The nozzle adapter 1050 may be fastened to the head 1010, such as by a threaded connection 1050*c*, thereby longitudinally and rotationally coupling the nozzle adapter to the head. The nozzle adapter 1050 may be made from a drillable material, such as a nonferrous metal or alloy (i.e., copper, brass, bronze, aluminum, zinc, tin, or alloys thereof), a polymer, or a composite.

The nozzle adapter 1050 may have a disk and a rim. The disk may have a thickness 1050*t*. The thickness 1050*t* may be sufficient to accommodate the nozzles 100, such as greater than or equal to one inch or one and one-half inches, or a combination of the facial thickness 1010*t* and the nozzle adapter thickness may be sufficient to accommodate the nozzles 100. The nozzle adapter 1050 may be further anchored to the head to facilitate drill-through. Each of the adapter thread and the head thread may have one or more recesses formed therein (not shown). The nozzle adapter 1050 may be screwed into the head until the connection 1050*c* is tight and then the recesses may be aligned. A key (not shown) may be inserted into each pair of aligned recesses, thereby ensuring that the nozzle adapter remains rotationally coupled to the head 1010 during drill through. The keys may be longitudinally kept with a fastener, such as a snap ring (not shown). Ports 1010*p*, 1050*p* may be formed through the face 1010*f* and nozzle adapter 1050 after the adapter is connected to the head 1010. The adapter surface defining each port 1050*p* may be threaded for fastening the nozzle retainer 105 thereto. The thread may or may not extend into the face 1010*f*. To prevent leakage of drilling fluid through an interface between the nozzle adapter 1050 and the head 1010, a seal, such as an o-ring 1052, may be disposed between the adapter and the head.

As compared to the casing bit 400, instead of shouldering against an inner surface of the face 410*f*, the adapter 1050 may have a shoulder 1050*s* for abutment with a corresponding shoulder formed in the head, thereby forming a longitudinal gap 1060 between an end of the adapter and an inner surface of the face 1010*f*.

Alternatively, the nozzle adapter 1050 may be coupled to the head by an interference fit, such as a press or shrink fit. Alternatively, the nozzle adapter 1050 may have one or more splines or keys formed on an outer surface thereof in engagement with corresponding splines or keyways formed on an inner surface of the head, thereby rotationally coupling the head and the nozzle adapter, and may be longitudinally coupled to the head by one or more fasteners. Alternatively, the nozzle adapter may be bonded to the head, such as by an adhesive, solder, weld, or braze or fastened with a different fastener, such as pins or set screws. Alternatively, the nozzle adapter may be galled to the head by using an anti-lubricant, such as discussed and illustrated in the '572 Provisional.

Figure 11:
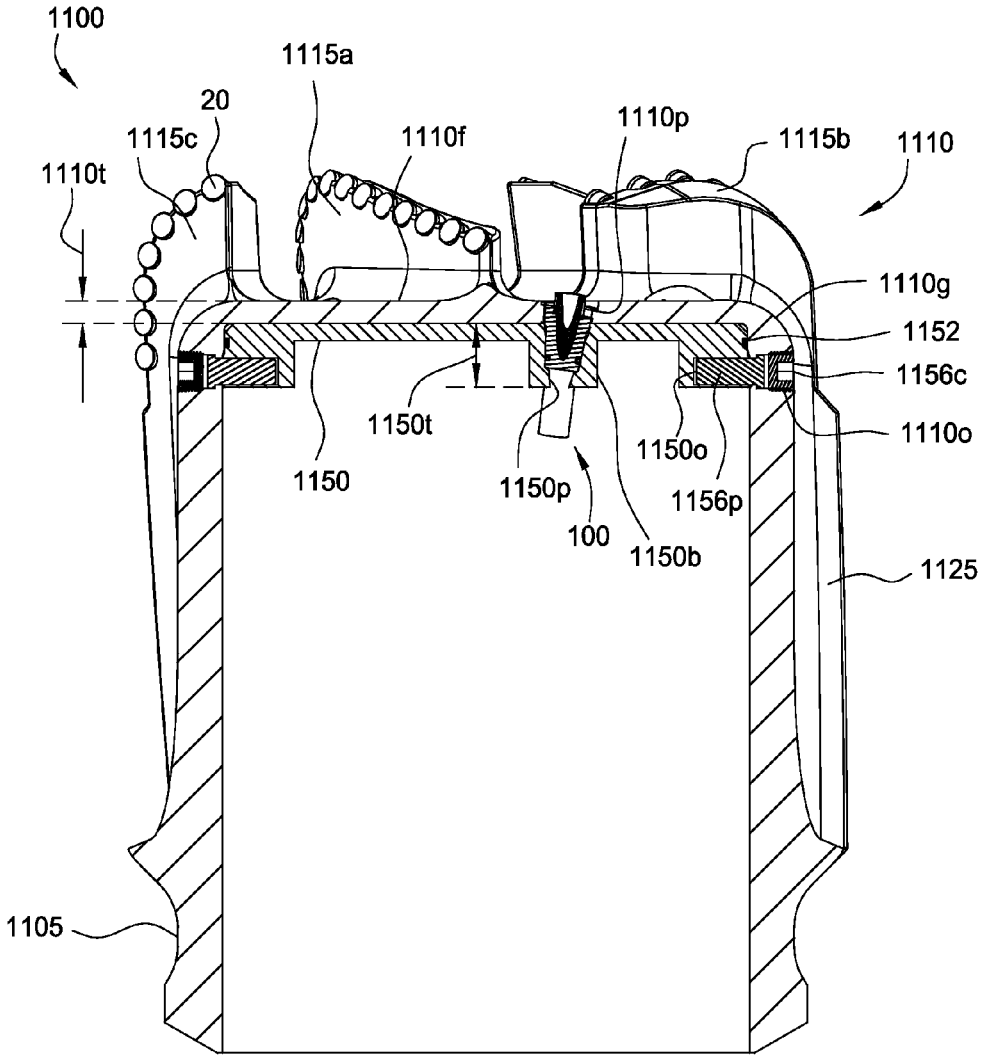
FIG. 11 is a cross section of a casing bit, according to another embodiment of the present invention.

FIG. 11 is a cross section of a casing bit 1100, according to another embodiment of the present invention. The casing bit 1100 may include a body 1105, a head 1110, one or more blades 1115*a-c*, one or more cutters 20, one or more stabilizers 1125, a nozzle adapter 1150, and one or more nozzles 100.

The casing bit 1100 may be similar to the casing bit 1 except that a nominal thickness 1110*t* of the face 1110*f* has been substantially reduced relative to the thickness 10*t* so that the casing bit 1100 may be drilled through by a standard drill bit (discussed above) or another casing bit without substantial damage thereto. The thickness 1110*t* may be less than or equal to one, three-quarters, one-half, or three-eighths of an inch. The nozzle adapter 1150 may be fastened to the head 1110, such as by one or more pins 1156*p*. Each pin 1156*p* may be inserted into an opening 1110*o* formed through the side 1110*g* until a head of the pin seats against a shoulder of the opening. A shank of the pin 1156*p* may extend through the opening 1110*o* and into an aligned opening 1150*o* formed in the outer surface of the nozzle adapter 1150. The pin 1156*p* may be retained by screwing a threaded cap 1156*c* into a threaded portion of the side opening 1110*o*. The nozzle adapter 1150 may be made from a drillable material, such as a nonferrous metal or alloy (i.e., copper, brass, bronze, aluminum, zinc, tin, or alloys thereof), a polymer, or a composite. The pins 1156*p* may also be made from one of the drillable materials (the same as or different from the selected material for the adapter).

The nozzle adapter 1150 may have a rim, a disk, and a boss 1150*b* for each nozzle 100. Each boss 1150*b* may extend from a rear of the nozzle adapter and have a thickness 1150*t*. The thickness 1150*t* may be sufficient to accommodate each nozzle 100, such as greater than or equal to one inch or one and one-half inches, or a combination of the facial thickness 1110*t* and the boss thickness 1150*t* may be sufficient to accommodate the nozzles 100. A seal, such as an o-ring 1152, may be disposed between the nozzle adapter 1150 and the head 1110. Ports 1110*p*, 1150*p* may be formed through the face 1110*f* and nozzle adapter 1150 before the adapter is connected to the head 1110. The port 1150*p* may be threaded for fastening the nozzle retainer 105 thereto. The thread may or may not extend into the face 1110*f*.

Alternatively, the nozzle adapter 1150 may be coupled to the head by an interference fit, such as a press or shrink fit. Alternatively, the nozzle adapter 1150 may have one or more splines or keys formed on an outer surface thereof in engagement with corresponding splines or keyways formed on an inner surface of the head, thereby rotationally coupling the head and the nozzle adapter, and may be longitudinally coupled to the head by one or more fasteners. Alternatively, the nozzle adapter may be bonded to the head, such as by an adhesive, solder, weld, or braze or fastened with a different fastener, such as set screws. Alternatively, the nozzle adapter may be galled to the head by using an anti-lubricant, such as discussed and illustrated in the '572 Provisional.

Figure 12:
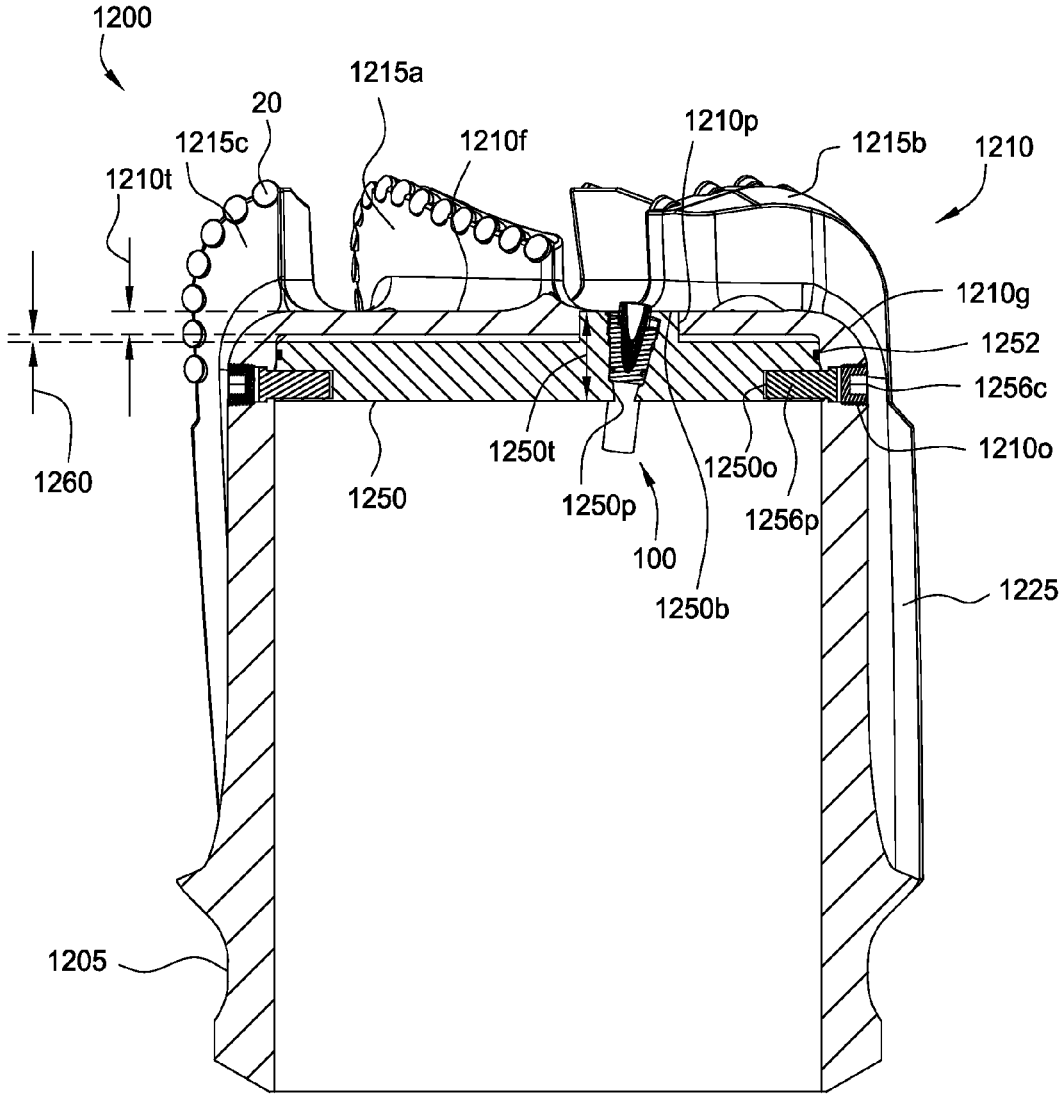
FIG. 12 is a cross section of a casing bit, according to another embodiment of the present invention.

FIG. 12 is a cross section of a casing bit 1200, according to another embodiment of the present invention. The casing bit 1200 may include a body 1205, a head 1210, one or more blades 1215*a-c*, one or more cutters 20, one or more stabilizers 1225, a nozzle adapter 1250, and one or more nozzles 100.

The casing bit 1200 may be similar to the casing bit 1 except that a nominal thickness 1210*t* of the face 1210*f* has been substantially reduced relative to the thickness 10*t* so that the casing bit 1200 may be drilled through by a standard drill bit (discussed above) or another casing bit without substantial damage thereto. The thickness 1210*t* may be less than or equal to one, three-quarters, one-half, or three-eighths of an inch. The nozzle adapter 1250 may be fastened to the head 1210, such as by one or more pins 1256*p*. Each pin 1256*p* may be inserted into an opening 1210*o* formed through the side 1210*g* until a head of the pin seats against a shoulder of the opening. A shank of the pin 1256*p* may extend through the opening 1210*o* and into an aligned opening 1250*o* formed in the outer surface of the nozzle adapter 1250. The pin 1256*p* may be retained by screwing a threaded cap 1256*c* into a threaded portion of the side opening 1210*o*. The nozzle adapter 1250 may be made from a drillable material, such as a nonferrous metal or alloy (i.e., copper, brass, bronze, aluminum, zinc, tin, or alloys thereof), a polymer, or a composite. The pins 1256*p* may also be made from one of the drillable materials (the same as or different from the selected material for the adapter).

The nozzle adapter 1250 may have a disk and a boss 1250*b* for each nozzle 100. Each boss 1250*b* may extend from a front of the nozzle adapter and into a respective face port 1210*p* so that an end of the boss is flush or slightly sub-flush with a front of the face 1210*f*. Each boss 1250*b* may have a thickness 1250*t*. The thickness 1250*t* may be sufficient to accommodate each nozzle 100, such as greater than or equal to one inch or one and one-half inches. A seal, such as an o-ring 1252, may be disposed between the nozzle adapter 1250 and the head 1210. Ports 1210*p*, 1250*p* may be formed through the face 1210*f* and nozzle adapter 1250 before the adapter is connected to the head 1210. The port 1250*p* may be threaded for fastening the nozzle retainer 105 thereto.

A longitudinal gap 1260 may be formed between an end of the adapter disk and an inner surface of the face 1210*f*. Alternatively, the gap 1260 may be omitted.

Alternatively, the nozzle adapter 1250 may be coupled to the head by an interference fit, such as a press or shrink fit. Alternatively, the nozzle adapter 1250 may have one or more splines or keys formed on an outer surface thereof in engagement with corresponding splines or keyways formed on an inner surface of the head, thereby rotationally coupling the head and the nozzle adapter, and may be longitudinally coupled to the head by one or more fasteners. Alternatively, the nozzle adapter may be bonded to the head, such as by an adhesive, solder, weld, or braze or fastened with a different fastener, such as set screws. Alternatively, the nozzle adapter may be galled to the head by using an anti-lubricant, such as discussed and illustrated in the '572 Provisional.

Figure 13:
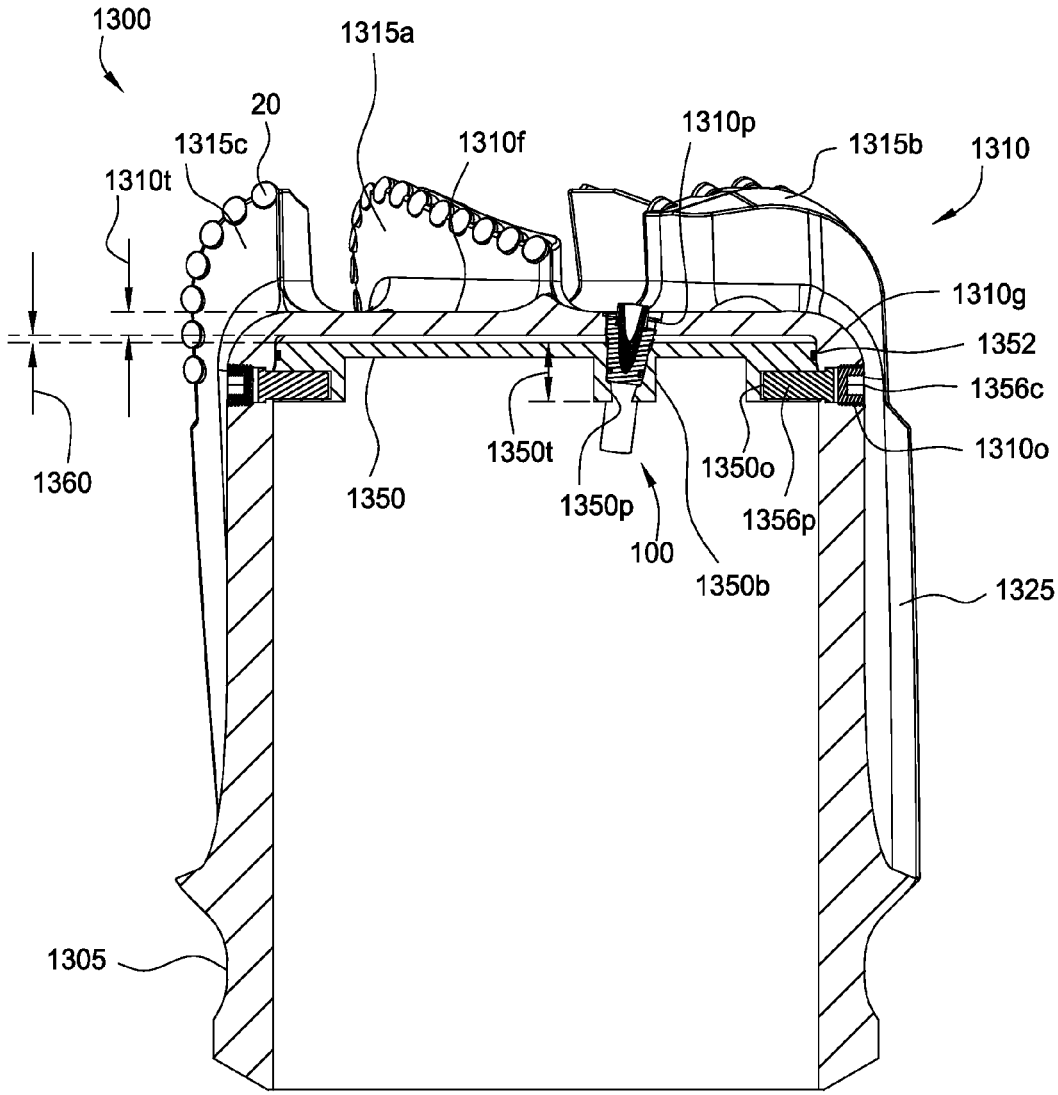
FIG. 13 is a cross section of a casing bit, according to another embodiment of the present invention.

FIG. 13 is a cross section of a casing bit 1300, according to another embodiment of the present invention. The casing bit 1300 may include a body 1305, a head 1310, one or more blades 1315*a-c*, one or more cutters 20, one or more stabilizers 1325, a nozzle adapter 1350, and one or more nozzles 100.

The casing bit 1300 may be similar to the casing bit 1 except that a nominal thickness 1310*t* of the face 1310*f* has been substantially reduced relative to the thickness 10*t* so that the casing bit 1300 may be drilled through by a standard drill bit (discussed above) or another casing bit without substantial damage thereto. The thickness 1310*t* may be less than or equal to one, three-quarters, one-half, or three-eighths of an inch. The nozzle adapter 1350 may be fastened to the head 1310, such as by one or more pins 1356*p*. Each pin 1356*p* may be inserted into an opening 1310*o* formed through the side 1310*g* until a head of the pin seats against a shoulder of the opening. A shank of the pin 1356*p* may extend through the opening 1310*o* and into an aligned opening 1350*o* formed in the outer surface of the nozzle adapter 1350. The pin 1356*p* may be retained by screwing a threaded cap 1356*c* into a threaded portion of the side opening 1310*o*. The nozzle adapter 1350 may be made from a drillable material, such as a nonferrous metal or alloy (i.e., copper, brass, bronze, aluminum, zinc, tin, or alloys thereof), a polymer, or a composite. The pins 1356*p* may also be made from one of the drillable materials (the same as or different from the selected material for the adapter).

The nozzle adapter 1350 may have a rim, a disk, and a boss 1350*b* for each nozzle 100. Each boss 1350*b* may extend from a rear of the nozzle adapter and have a thickness 1350*t*. The thickness 1350*t* may be sufficient to accommodate each nozzle 100, such as greater than or equal to one inch or one and one-half inches, or a combination of the facial thickness 1310*t* and the boss thickness 1350*t* may be sufficient to accommodate the nozzles 100. A seal, such as an o-ring 1352, may be disposed between the nozzle adapter 1350 and the head 1310. Ports 1310*p*, 1350*p* may be formed through the face 1310*f* and nozzle adapter 1350 before the adapter is connected to the head 1310. The port 1350*p* may be threaded for fastening the nozzle retainer 105 thereto. The thread may or may not extend into the face 1310*f*.

A longitudinal gap 1360 may be formed between an end of the adapter 1350 and an inner surface of the face 1310*f*. Alternatively, the gap 1360 may be omitted.

Alternatively, the nozzle adapter 1350 may be coupled to the head by an interference fit, such as a press or shrink fit. Alternatively, the nozzle adapter 1350 may have one or more splines or keys formed on an outer surface thereof in engagement with corresponding splines or keyways formed on an inner surface of the head, thereby rotationally coupling the head and the nozzle adapter, and may be longitudinally coupled to the head by one or more fasteners. Alternatively, the nozzle adapter may be bonded to the head, such as by an adhesive, solder, weld, or braze or fastened with a different fastener, such as set screws. Alternatively, the nozzle adapter may be galled to the head by using an anti-lubricant, such as discussed and illustrated in the '572 Provisional.

Figure 14:
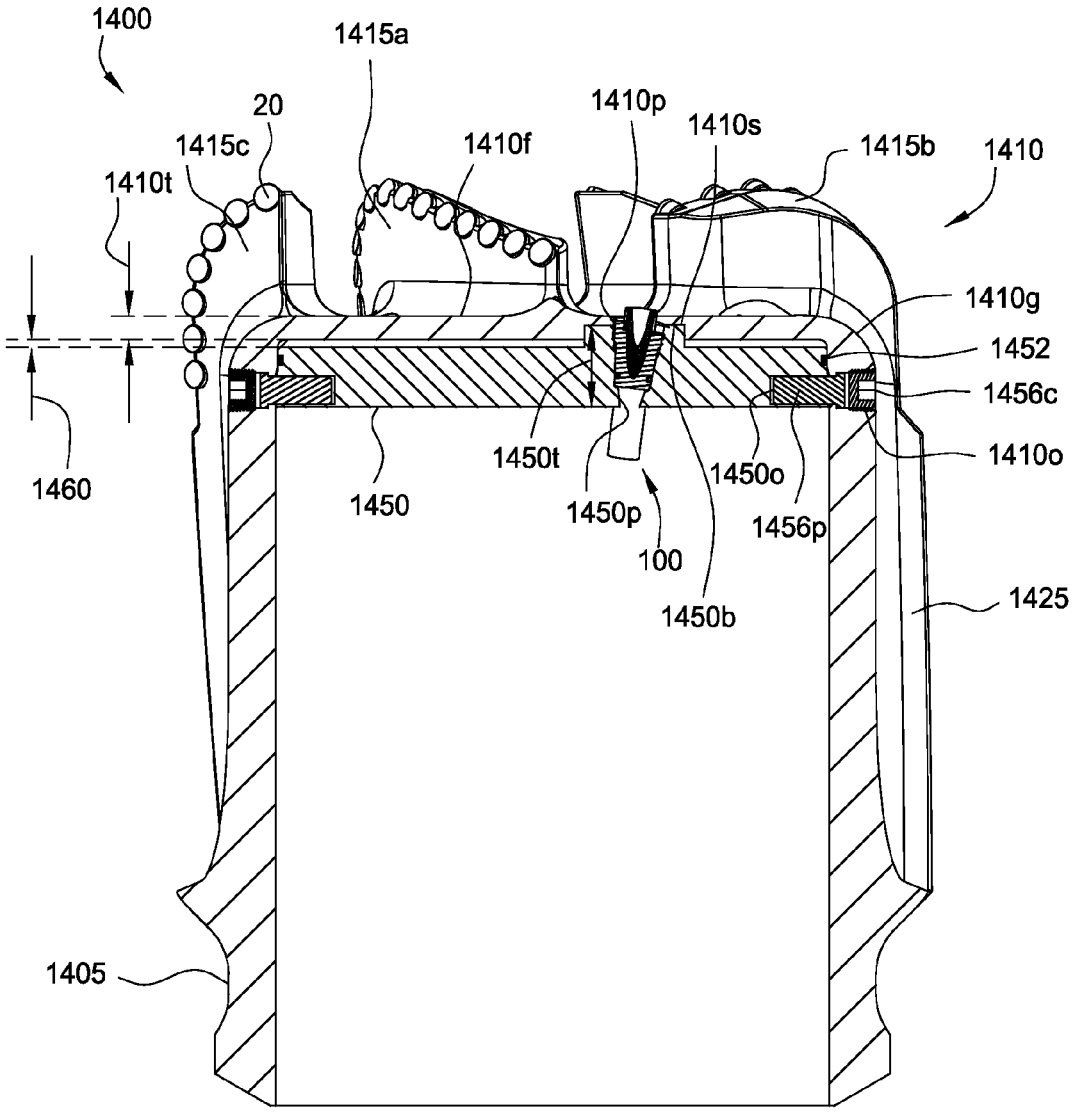
FIG. 14 is a cross section of a casing bit, according to another embodiment of the present invention.

FIG. 14 is a cross section of a casing bit 1400, according to another embodiment of the present invention. The casing bit 1400 may include a body 1405, a head 1410, one or more blades 1415*a-c*, one or more cutters 20, one or more stabilizers 1425, a nozzle adapter 1450, and one or more nozzles 100.

The casing bit 1400 may be similar to the casing bit 1 except that a nominal thickness 1410*t* of the face 1410*f* has been substantially reduced relative to the thickness 10*t* so that the casing bit 1400 may be drilled through by a standard drill bit (discussed above) or another casing bit without substantial damage thereto. The thickness 1410*t* may be less than or equal to one, three-quarters, one-half, or three-eighths of an inch. The nozzle adapter 1450 may be fastened to the head 1410, such as by one or more pins 1456*p*. Each pin 1456*p* may be inserted into an opening 1410*o* formed through the side 1410*g* until a head of the pin seats against a shoulder of the opening. A shank of the pin 1456*p* may extend through the opening 1410*o* and into an aligned opening 1450*o* formed in the outer surface of the nozzle adapter 1450. The pin 1456*p* may be retained by screwing a threaded cap 1456*c* into a threaded portion of the side opening 1410*o*. The nozzle adapter 1450 may be made from a drillable material, such as a nonferrous metal or alloy (i.e., copper, brass, bronze, aluminum, zinc, tin, or alloys thereof), a polymer, or a composite. The pins 1456*p* may also be made from one of the drillable materials (the same as or different from the selected material for the adapter).

The nozzle adapter 1450 may have a disk and a boss 1450*b* for each nozzle 100. Each boss 1450*b* may extend from a front of the nozzle adapter and into a respective face port 1410*p* and engage a shoulder 1410*s* formed in the face port 1410*p*. Each boss 1450*b* may have a thickness 1450*t*. The thickness 1450*t* may be sufficient to accommodate each nozzle 100, such as greater than or equal to one inch or one and one-half inches, or a combination of the facial thickness 1410*t* and the boss thickness 1450*t* may be sufficient to accommodate the nozzles 100. A seal, such as an o-ring 1452, may be disposed between the nozzle adapter 1450 and the head 1410. Ports 1410*p*, 1450*p* may be formed through the face 1410*f* and nozzle adapter 1450 before the adapter is connected to the head 1410. The port 1450*p* may be threaded for fastening the nozzle retainer 105 thereto. The thread may or may not extend into the face 1410*f*.

A longitudinal gap 1460 may be formed between an end of the adapter disk and an inner surface of the face 1410*f*. Alternatively, the gap 1460 may be omitted.

Alternatively, the nozzle adapter 1450 may be coupled to the head by an interference fit, such as a press or shrink fit. Alternatively, the nozzle adapter 1450 may have one or more splines or keys formed on an outer surface thereof in engagement with corresponding splines or keyways formed on an inner surface of the head, thereby rotationally coupling the head and the nozzle adapter, and may be longitudinally coupled to the head by one or more fasteners. Alternatively, the nozzle adapter may be bonded to the head, such as by an adhesive, solder, weld, or braze or fastened with a different fastener, such as set screws. Alternatively, the nozzle adapter may be galled to the head by using an anti-lubricant, such as discussed and illustrated in the '572 Provisional.

Figure 15:
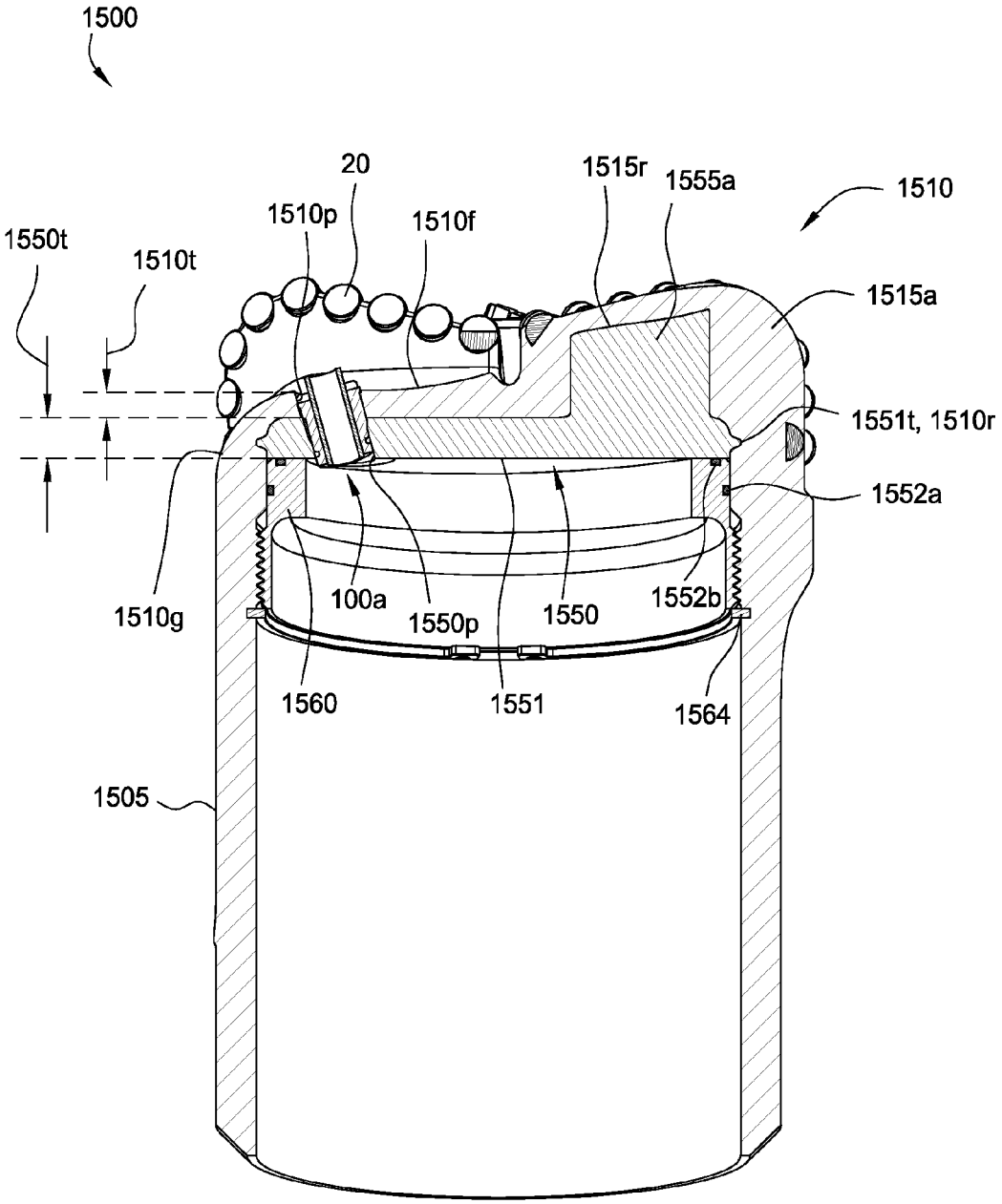
FIG. 15 is a cross section of a casing bit, according to another embodiment of the present invention.

FIG. 15 is a cross section of a casing bit 1500, according to another embodiment of the present invention. The casing bit 1500 may include a body 1505, a head 1510, one or more blades 1515*a*, one or more cutters 20, one or more stabilizers (not shown), a nozzle adapter 1550, a plug 1560, and one or more nozzles 100*a*.

The casing bit 1500 may be similar to the casing bit 1 except that a nominal thickness 1510*t* of the face 1510*f* has been substantially reduced relative to the thickness 10*t* so that the casing bit may be drilled through by a standard drill bit (discussed above) or another casing bit without substantial damage thereto. The thickness 1510*t* may be less than or equal to one, three-quarters, one-half, or three-eighths of an inch. The nozzle 100*a* may be disposed in the adapter port 1550*p* and may extend into or through the face port 1510*p*. The nozzle adapter 1550 may have a disk 1551 and one or more anchors 1555*a*. The disk 1551 may have a thickness 1550*t*.

The thickness 1550*t* may be sufficient to accommodate the nozzles 100*a*, such as greater than or equal to one inch or one and one-half inches, or a combination of the facial thickness 1510*t* and the adapter thickness 1550*t* may be sufficient to accommodate the nozzles 100*a*. Similar to the nozzle adapters 550,650, the adapter 1550 may be cast/molded into the head 1510 by using the head as a mold. The nozzle adapter 1550 may be longitudinally and rotationally coupled to the head by the locking profile 1551*t*,1510*r*.

The plug 1560 may be annular and may be fastened to the head 1510, such as by a threaded connection, thereby longitudinally and rotationally coupling the plug to the head. The plug 1560 may be installed after the nozzle adapter 1550 has cooled/solidified from casting/molding. The plug 1560 may be further anchored to the head 1510 to facilitate drill-through. Each of the plug thread and the head thread may have one or more recesses formed therein. The plug may be screwed into the head until the connection is tight and then the recesses may be aligned. A key may be inserted into each pair of aligned recesses, thereby ensuring that the plug remains rotationally coupled to the head during drill through. The keys may be longitudinally kept with a fastener, such as a snap ring 1564. Alternatively, the plug 1560 may be bonded to the head 1510, such as by an adhesive, solder, weld, braze, or galling. To prevent leakage of drilling fluid through an interface between the plug and the head, one or more seals, such as O-rings 1552*a,b*, may be disposed between the plug and the head and/or between the plug and nozzle adapter.

The nozzle adapter 1550 and plug 1560 may each be made from a drillable material, such as a nonferrous metal or alloy (i.e., copper, brass, bronze, aluminum, zinc, tin, or alloys thereof), a polymer, or a composite. The nozzle adapter and plug may be made from the same or different drillable material. As with the nozzle adapters 550/650, if the adapter 1550 is metallic having a substantially different TEC, then voids may be formed upon cooling. Addition of the plug 1560 provides separate seals 1552*a,b* negating risk of erosion of the nozzle adapter due to leakage of the drilling fluid.

Each nozzle 100*a* may be modified from the nozzle 100 so as not to extend into a bore of the plug 1560. Alternatively, each nozzle may be the nozzle 100 and may extend into the plug bore. Alternatively, the plug may include a disk having a port formed therethrough corresponding to each nozzle and be fastened to the head using pins or screws.

Figure 16A:
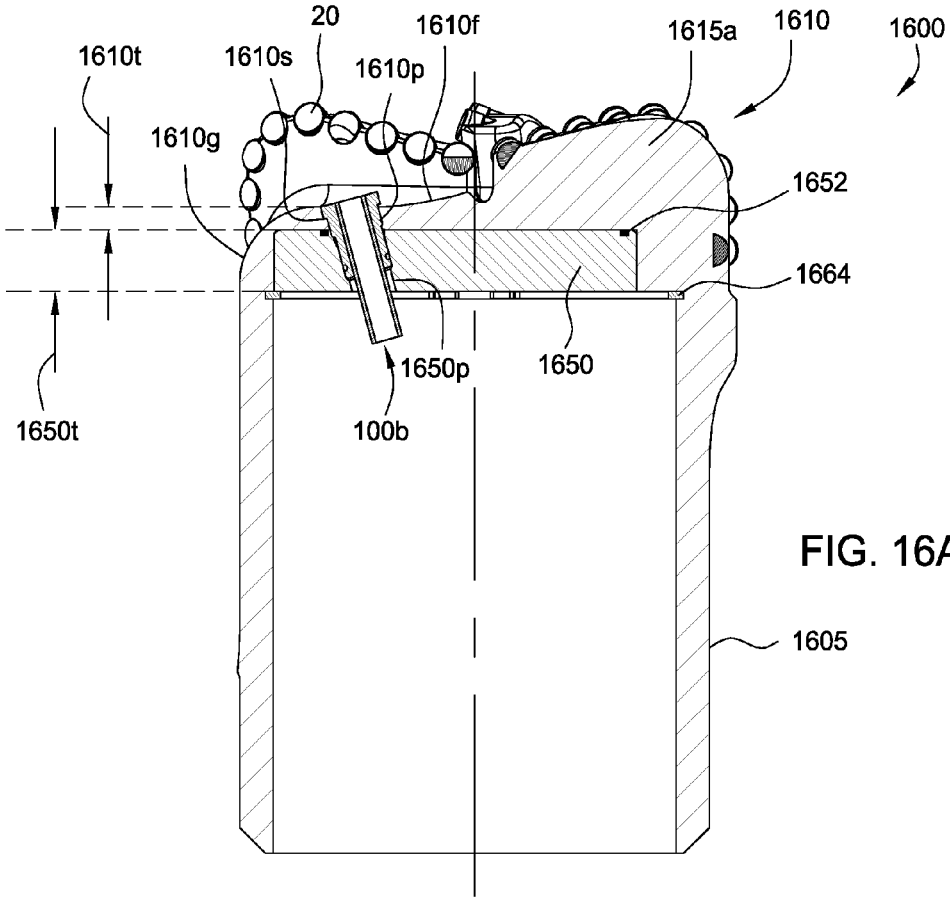
FIG. 16A is a cross section of a casing bit, according to another embodiment of the present invention.
Figure 16B:
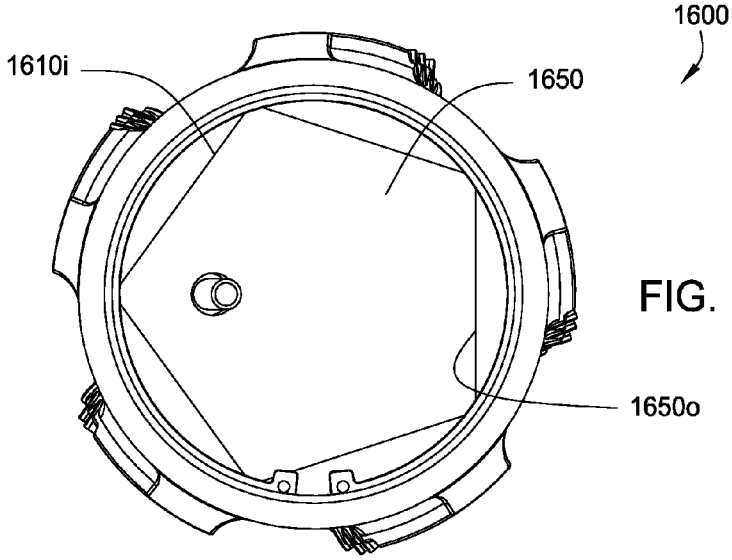
FIG. 16B is a rear end view of the head.

FIG. 16A is a cross section of a casing bit 1600, according to another embodiment of the present invention. FIG. 16B a rear end view of the head 1610. The casing bit 1600 may include a body 1605, a head 1610, one or more blades 1615*a*, one or more cutters 20, one or more stabilizers (not shown), a nozzle adapter 1650, and one or more nozzles 100*b*.

The casing bit 1600 may be similar to the casing bit 1 except that a nominal thickness 1610*t* of the face 1610*f* has been substantially reduced relative to the thickness 10*t* so that the casing bit may be drilled through by a standard drill bit (discussed above) or another casing bit without substantial damage thereto. The thickness 1610*t* may be less than or equal to one, three-quarters, one-half, or three-eighths of an inch. The nozzle adapter 1650 may be made from a drillable material, such as a nonferrous metal or alloy (i.e., copper, brass, bronze, aluminum, zinc, tin, or alloys thereof), a polymer, or a composite.

The nozzle adapter 1650 may be a disk having a thickness 1650*t*. The thickness 1650*t* may be sufficient to accommodate the nozzles 100*b*, such as greater than or equal to one inch or one and one-half inches, or a combination of the facial thickness 1610*t* and the nozzle adapter thickness 1650*t* may be sufficient to accommodate the nozzles 100*b*. The nozzle 100*b* may be disposed in the adapter port 1650*p* and may extend into or through the face port 1610*p*. Each nozzle 100*b* may be modified from the nozzle 100 so that a head of the nozzle retainer seats 1610*s* in a profile formed in the face port 1610*p*, thereby longitudinally coupling the nozzle adapter 1650 to the head 1610. Each nozzle 100*b* may also serve to rotationally couple the nozzle adapter to the head. Alternatively or additionally, the nozzle adapter 1650 may be fastened to the head 1610, such as by snap ring 1664, thereby longitudinally coupling the nozzle adapter to the head. Alternatively or additionally, the nozzle adapter 1650 may be rotationally coupled to the head by a profile formed in an inner surface 1610*i* of the head and an outer surface 1650*o* of the nozzle adapter. The profile may be polygonal, such as a pentagon. Alternatively, the profile may be splines or keys/keyways.

To prevent leakage of drilling fluid through an interface between the nozzle adapter 1650 and the head 1610, a seal, such as an o-ring 1652, may be disposed between the adapter and the head.

Alternatively, the nozzle adapter may be bonded to the head, such as by an adhesive, solder, weld, or braze or fastened with a different fastener, such as pins or set screws. Alternatively, the nozzle adapter may be galled to the head by using an anti-lubricant, such as discussed and illustrated in the '572 Provisional.

Alternatively, the nozzle 100*b* may be used to longitudinally and/or rotationally couple the nozzle adapter to the head for any of the other casing bits 400-1500.

In another embodiment (not shown), any of the casing bits 1, 200-1600 may be modified so that the bodies thereof include one or more circulation ports as discussed and illustrated in U.S. Pat. App. Pub. No. 2006/0185855, which is herein incorporated by reference in its entirety. As discussed in the '855 publication, the circulation ports may be formed through a wall of the body and initially sealed by a frangible member, such as a burst tube, lining an inner surface of the body wall. The circulation ports may be useful in a drilling with casing/liner operation to facilitate circulation and cementing of the casing/liner after the casing/liner is drilled to the desired depth. The burst tube may be made from a drillable material. During drilling with the casing bit, the circulation ports may remain sealed. When circulating before cementing an injection rate of circulation fluid, such as drilling mud, may be increased to rupture the burst tube. The circulation and cementing operation may be performed and the casing bit may then be drilled through.

Specific design criteria of any of the casing bits 1, 200-1600, such as the number and placement of the nozzles 100, length of standoffs 109, 111, and flow tube 110 diameter (or body 175 diameter), may be customized for each specific application. Factors may include weight on bit, rotary speed of bit, hole depth, hole direction, drilling fluid parameters, circulation rate, gage of the hole, and formation parameters. Advantageously, fastening of the nozzles 100, 150 to the bits 1, 200-1400 allows change-out of the nozzles 100, 150 at the rig-site. This allows the rig operator greater flexibility to adjust to actual conditions experienced downhole.

Alternatively, any of the other casing bits 400-900, 1100, 1500, 1600 may include a longitudinal gap formed between an end of the adapter and an inner surface of the face.

Alternatively, any of the casing bits 1, 200-1600 may be used to run-in or ream-in casing/liner into a pre-drilled wellbore.

Alternatively, the blades 15, 215-1615 of any of the casing bits 1, 200-1600 may be omitted and the cutters 20 may be disposed in the respective heads, such as in the face and/or side. Alternatively, the blades 15, 215-1615 of any of the casing bits 1, 200-1600 may be bonded or otherwise attached to the respective heads, such as by welding, brazing, soldering, or using an adhesive. In this alternative, the blades may be made from a drillable material, such as a nonferrous metal or alloy (i.e., copper, brass, bronze, aluminum, zinc, tin, or alloys thereof), a polymer, or composite.

Alternatively, any of the nozzle adapters 450-1650 may be bonded to the respective heads 410-1610, such as by an adhesive, solder, weld, or braze or fastened with any fastener, such as thread, pins or set screws. Alternatively, any of the nozzle adapters may be galled to the head by using an anti-lubricant, such as discussed and illustrated in the '572 Provisional. Alternatively, any of the nozzles 100, 100*a*, 100*b* may be bonded to the respective nozzle adapters 450-1650, such as by an adhesive, solder, weld, or braze. Alternatively, any of the nozzles may be galled to the respective nozzle adapters by using an anti-lubricant.

Alternatively, the retainers 105 of any of the nozzles 100, 100*a*, 100*b* may be omitted and the flow tubes 110 may instead be bonded, fastened, or galled to the respective bosses/adapters 250-1650.

While the foregoing is directed to embodiments of the present invention, other and further embodiments of the invention may be devised without departing from the basic scope thereof, and the scope thereof is determined by the claims that follow.

The invention claimed is:

1. An earth removal member for drilling a wellbore with casing or liner, comprising:
- a tubular body;
- a head fastened to or formed with an end of the body, having a face and a side, made from a high strength material, and having head ports formed through the face;
- a blade formed on the head, extending from the side and along the face, and made from the high strength material;
- cutters disposed along the blade;
- nozzle adapters, each nozzle adapter disposed in a respective head port and having an adapter port formed therethrough, each nozzle adapter longitudinally and rotationally coupled to the head, and each nozzle adapter made from a drillable material selected from a group consisting of copper, brass, bronze, aluminum, zinc, tin, alloys thereof, or a polymer;
- a nozzle disposed in each adapter port and fastened to the respective nozzle adapter,
- wherein:
  - a nominal thickness of the face facilitates drill-through by a drill bit,
  - each nozzle adapter has a thickness greater than the nominal thickness, and
  - a length of each nozzle is greater than the nozzle adapter thickness.

2. The earth removal member of claim 1, wherein the nozzle comprises:
- a retainer made from a drillable material, and
- a flow tube bonded to the retainer and made from a ceramic or cermet.

3. The earth removal member of claim 1, wherein the high strength material is a metal or alloy.

4. The earth removal member of claim 3, wherein the high strength material is steel.

5. The earth removal member of claim 1, wherein each nozzle adapter is coupled to the head by a threaded connection.

6. An earth removal member for drilling a wellbore with casing or liner, comprising:
- a tubular body;
- a head fastened to or formed with an end of the body, having a face and a side, and having a threaded head port formed through the face;
- a blade formed on the head, extending from the side and along the face;
- cutters disposed along the blade;
- a nozzle adapter disposed in the head port, having an external thread and a threaded adapter port formed therethrough, and fastened to the face from inside the head by engagement of the external thread with the threaded head port; and a nozzle comprising a retainer having an external thread, disposed in the adapter port and fastened to the nozzle adapter from an exterior of the head by engagement of the external thread with the threaded adapter port, wherein the adapter port and external adapter threads are opposite-handed.

7. The earth removal member of claim 6, wherein the earth removal member comprises a plurality of nozzle adapters and a plurality of nozzles.

8. The earth removal member of claim 7, wherein each nozzle adapter includes an internal shoulder and an external shoulder.

9. The earth removal member of claim 8, wherein:

each retainer is made from a drillable material, and each nozzle further comprises a flow tube bonded to the retainer and made from a ceramic or cermet.

10. The earth removal member of claim 9, wherein each nozzle retainer has and a shoulder.

11. The earth removal member of claim 6, wherein the head and blade are each made from a high strength material.

12. The earth removal member of claim 11, wherein the high strength material is a metal or alloy.

13. The earth removal member of claim 12, wherein the high strength material is steel.

14. The earth removal member of claim 6, wherein the nozzle adapter is made from a drillable material.

15. An earth removal member for drilling a wellbore with casing or liner, comprising:

a tubular body;

a head fastened to or formed with an end of the body, having a face and a side;

a blade formed on the head, extending from the side and along the face;

cutters disposed along the blade;

a nozzle adapter having an adapter port formed therethrough and fastened to the face from inside the head; and a nozzle disposed in the adapter port and fastened to the nozzle adapter from an exterior of the head, wherein:

the head further comprises a head port formed through the face, the nozzle adapter is disposed in the head port the earth removal member comprises a plurality of nozzle adapters and a plurality of nozzles, the head ports are threaded, each nozzle adapter is fastened to the face by a threaded connection, each nozzle is fastened to the respective nozzle adapter by a threaded connection, each nozzle adapter includes an internal thread and shoulder, and an external thread and shoulder, each nozzle adapter is fastened to the face by engagement of the external thread with the respective threaded port and engagement of the external shoulder with an inner surface of the face, and the internal and external adapter threads are opposite-handed.

16. The earth removal member of claim 15, wherein each nozzle comprises:

a retainer made from a drillable material, and a flow tube bonded to the retainer and made from a ceramic or cermet.

17. The earth removal member of claim 16, wherein:

each nozzle retainer has an external thread and shoulder, and each nozzle retainer is fastened to the respective nozzle adapter by engagement of the nozzle retainer thread and shoulder with the respective nozzle adapter internal thread and shoulder.

* * * * *